US008007338B2

(12) United States Patent
Stevkovski

(10) Patent No.: US 8,007,338 B2
(45) Date of Patent: Aug. 30, 2011

(54) CONSTRUCTION SYSTEM AND APPLICATIONS THEREOF

(76) Inventor: Saso Stevkovski, Vienna (AT)

( * ) Notice: Subject to any disclaimer, the term of this patent is extended or adjusted under 35 U.S.C. 154(b) by 180 days.

(21) Appl. No.: 12/142,042

(22) Filed: Jun. 19, 2008

(65) Prior Publication Data

US 2009/0191784 A1 Jul. 30, 2009

(30) Foreign Application Priority Data

Jan. 25, 2008 (EP) ..... 08150633

(51) Int. Cl.
*A63H 33/06* (2006.01)

(52) U.S. Cl. ..... 446/120; 446/85; 446/97; 446/101; 446/124; 446/125

(58) Field of Classification Search ..... 446/85, 446/97, 100, 101, 118–122, 124–128
See application file for complete search history.

(56) References Cited

U.S. PATENT DOCUMENTS 2,959,888 A * 11/1960 Noble ..... 446/120
3,234,683 A * 2/1966 Christiansen ..... 446/103
3,392,480 A * 7/1968 Stubbmann ..... 446/121
3,597,874 A * 8/1971 Ogsbury et al. ..... 446/104
4,355,781 A * 10/1982 Stolpin ..... 249/64
4,629,192 A * 12/1986 Nichols ..... 273/156
4,964,833 A * 10/1990 Suzuki ..... 446/118
5,611,187 A * 3/1997 Jones ..... 52/646
5,779,515 A * 7/1998 Chung ..... 446/90
5,897,417 A * 4/1999 Grey ..... 446/125
6,315,628 B1 * 11/2001 Quercetti ..... 446/128
6,648,715 B2 * 11/2003 Wiens et al. ..... 446/121
6,665,993 B2 * 12/2003 Sorensen et al. ..... 52/591.2
7,140,944 B2 * 11/2006 Harris ..... 446/118

* cited by examiner

*Primary Examiner* — Alvin Hunter
*Assistant Examiner* — Joseph B Baldori
(74) *Attorney, Agent, or Firm* — Edwin D. Schindler

(57) ABSTRACT

A construction system includes a plurality of construction elements having body member and a plurality of coupling members, each of said coupling members having an exterior portion and an interior locking device of hermaphroditic type. The interior locking device includes protrusions and a receiving block. A first coupling member belonging to one construction element can interlock with a second coupling member belonging to another element, so that the protrusions of the first coupling member resiliently deflect away from each other and subsequently retract, and settle, into provided recesses in the receiving block of the second element. Concurrently, the protrusions of the second coupling member settle into corresponding recesses in the receiving block of the first coupling member. Applications of the construction system in toy construction sets, construction puzzles and board games are provided.

18 Claims, 30 Drawing Sheets

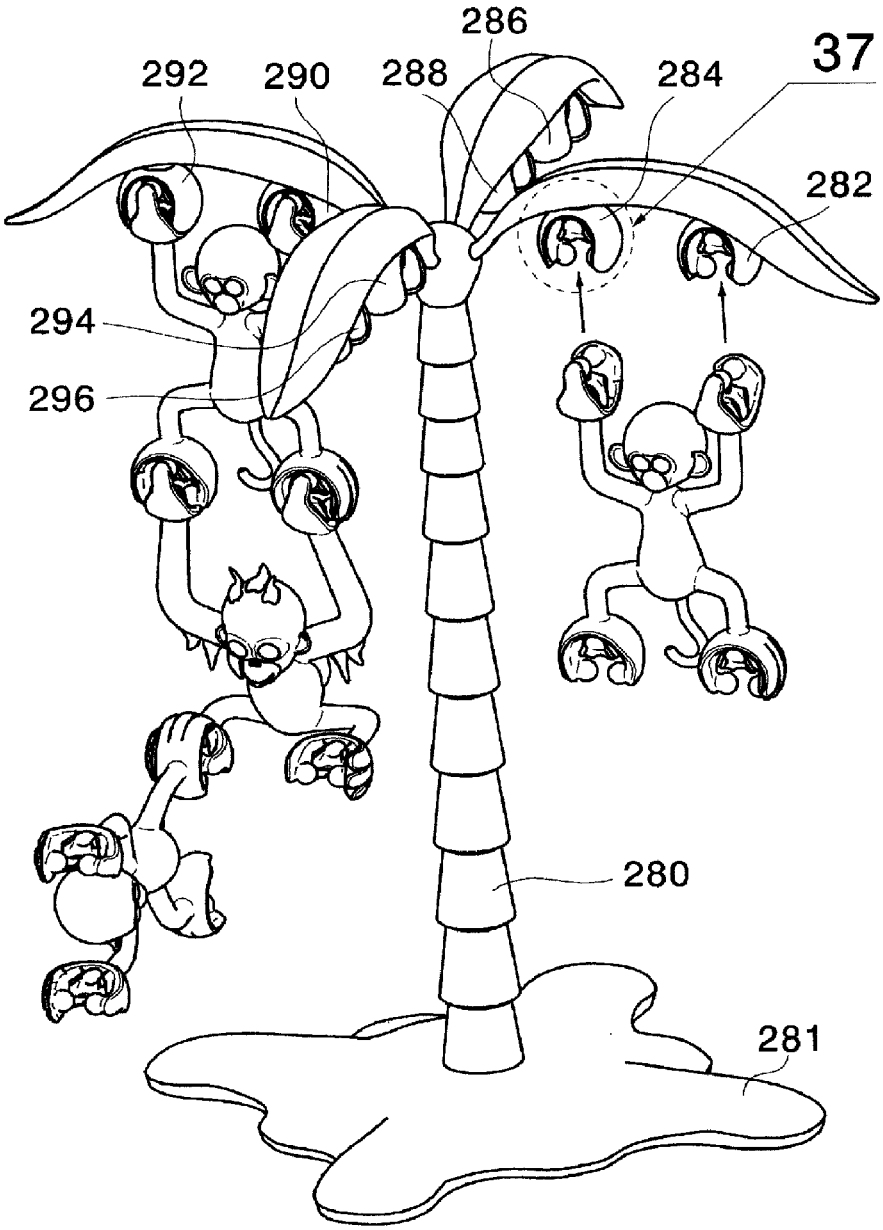
FIG.36
FIG.37
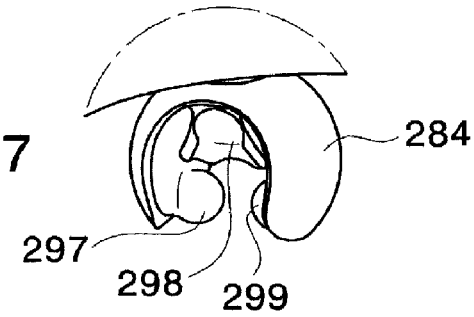

CONSTRUCTION SYSTEM AND APPLICATIONS THEREOF

BACKGROUND OF THE INVENTION

1. Technical Field of the Invention

The present invention relates, generally, to a construction system having a plurality of construction elements, and specifically to construction elements having identically shaped interlocking portions.

The present invention, more particularly, relates to applications of the construction system in toy construction sets, two-dimensional or three-dimensional construction puzzles and board games.

2. Description of the Prior Art

At present, there exist numerous construction systems that include male and female interlocking members. Also known in the prior art are construction systems including identically shaped interlocking portions.

One such construction system is disclosed in U.S. Pat. No. 4,548,590, wherein resiliently openable jaws provide means for connection. U.S. Pat. No. 5,897,417 discloses a socket-to-socket construction system where the interlocking sockets form a sphere. The interlocking effect is provided solely by the specific irregular shape of the socket's contours, where the contour of the outer portions of the first socket is complementary to the contour of the inner portions of the second socket, and vice versa.

The function of the above, as well as other systems known in prior art, is inevitably linked to the geometric shape of the connecting resilient jaws or sockets, which limits their application scope. For instance, stylistic variations or more radical geometric adjustments of the coupling members are generally not possible because their functionality could be adversely affected. In other words, the coupling members must generally look the way it is required by definition, and furthermore they must look alike for all construction elements.

Furthermore, connections of such character tend to decouple easily even if a force is applied in directions other than the desired decoupling direction, which comes from the fact that the resisting resilient force is distributed all along the interface contours and in various directions depending on the curvature of the coupling member. Such behaviour is mostly apparent in cases where a force that causes a moment about the centre of the connection is applied to one of the connected elements, in which case the coupled contours slip away from each other resulting ultimately in decoupling.

A need exists therefore for a construction system where there are no stylistic or geometrical restrictions concerning the shape of the coupling members. Various construction elements can therefore comprise differently shaped coupling members that are still interlockable. Furthermore, a need exists for a construction system that provides an easily achieved and stable connection, and where the coupling members can basically be disconnected only if the force is applied along the desired decoupling direction.

SUMMARY OF THE INVENTION

It is, therefore, an object of the present invention is to provide a construction system comprising construction elements with a plurality of coupling members, wherein the construction elements can be easily connected/disconnected to/from each other in a functional and stable manner to form a diversity of visually pleasant open-end shapes, as well as closed geometric shapes.

It is a further object of the present invention is to provide coupling means with no stylistic or geometric limitations related to their exterior shape, yet including interlocking inner portions that are identical for all construction elements.

It is, yet, another object of the present invention is to provide means and methods of playing games with the construction elements, wherein additional board elements serve as playing boards for the games. The board elements comprise coupling means with interlocking features identical to the ones of the playing elements.

Another purpose of the present invention is to provide coupling means that can be easily manufactured as an integral part of the construction element, or manufactured separately and then assembled to the body of the element in a secure and simple manner.

The foregoing and related objects are achieved by the present invention, which provides a construction system comprising construction elements that have a plurality of coupling members with interlocking means of a hermaphroditic type. One basic characteristic of the present invention is that a single coupling member generally comprises of two portions, each portion having distinctive functions:

1) An interior locking portion of a hermaphroditic type comprising a plurality of protrusions and an equivalent number of recesses. This portion is identical for all coupling members belonging to one set of construction elements. The function of this portion is to enable easy and reliable connection of two coupling members.
2) An exterior portion having an open loop shape with two wings, such as C-shape or U-shape. The function of this portion is to integrate the interior locking means into a functionally and visually compact unit, and to provide a resilient force when the wings are deflected or retracted during the engagement or disengagement of the couplings members.

This separation of functions allows for unlimited possibilities for geometric and stylistic execution of the exterior portion, as long as the required resilient force is provided. The interior locking portion, on the other hand, remains generally hidden once a connection has taken place.

The present invention also discloses playing sets comprising a plurality of construction elements. Beside the classic open-end construction sets, this invention discloses puzzle-type construction sets where the construction elements can be connected in a predetermined way unknown to the player to form regular or irregular closed geometric shapes. Lastly, the present invention discloses means and methods of playing board games with the elements of the construction system.

Other objects and features of the present invention will become apparent when considered in combination with the accompanying drawing figures which illustrate certain preferred embodiments of the present invention. It should, however, be noted that the accompanying drawing figures are intended to illustrate only certain embodiments of the claimed invention and are not intended as a means for defining the limits and scope of the invention.

BRIEF DESCRIPTION OF THE DRAWING FIGURES

In the drawings, wherein similar reference numerals and symbols denote similar features throughout the several views:

FIG. 36 is an isometric view of another tree-like support element adapted to receive a plurality of construction elements;

FIG. 37 is a detailed view of the area marked "37" of FIG. 36;

DETAILED DESCRIPTION OF THE DRAWING FIGURES AND PREFERRED EMBODIMENTS

Figure 1:
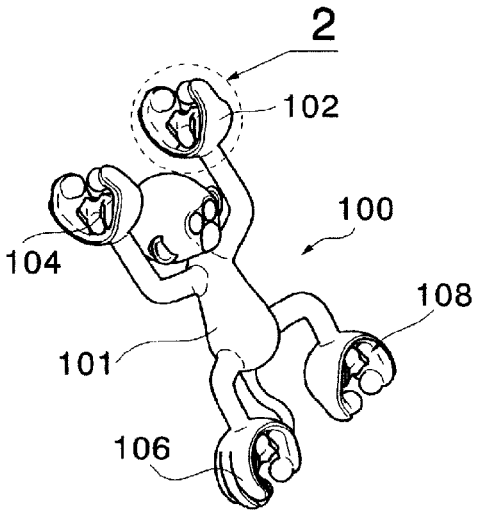
FIG. 1 is an isometric view of a monkey-like construction element.
Figure 2:
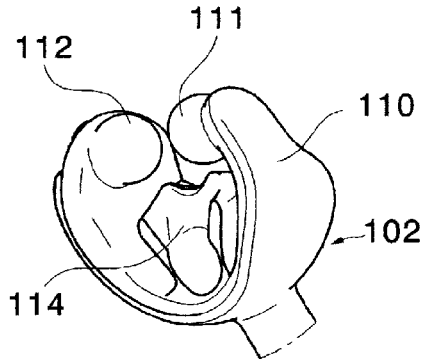
FIG. 2 is a detailed view of the area marked 2 in FIG. 1.
Figure 3:
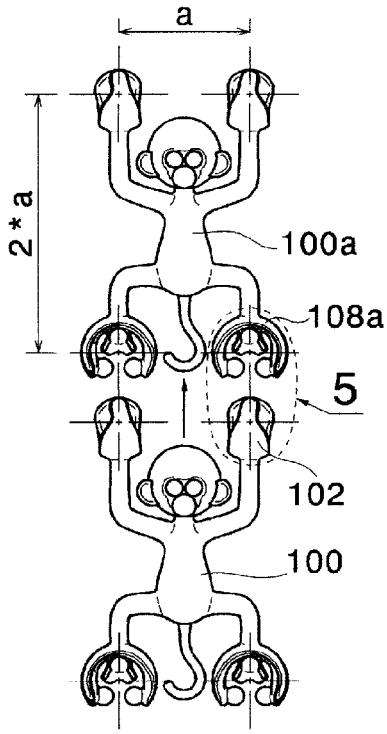
FIG. 3 is a front view of two monkey-like construction elements.
Figure 4:
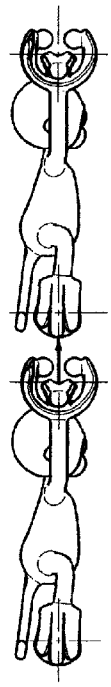
FIG. 4 is a side view of the elements shown in FIG. 3.
Figure 5:
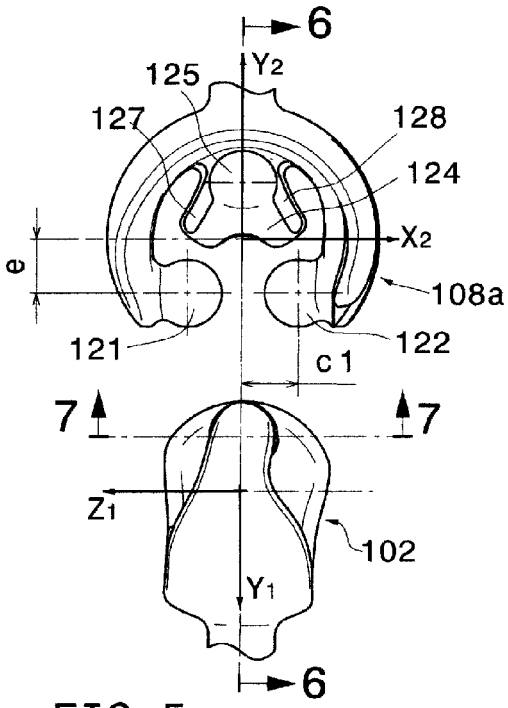
FIG. 5 is a detailed view of the area marked 5 in FIG. 3.
Figure 6:
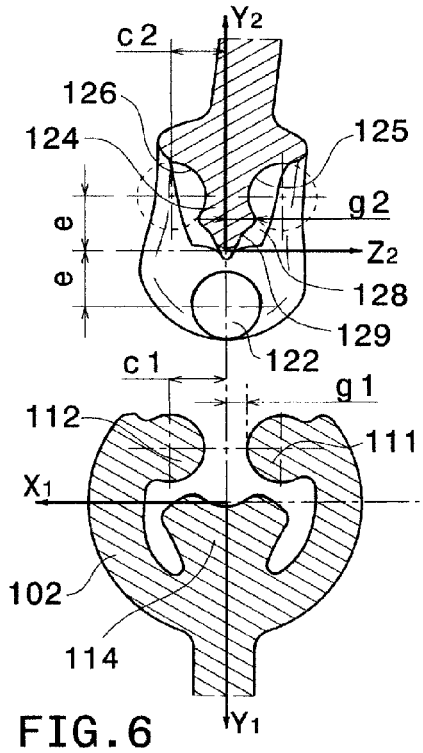
FIG. 6 is a sectional view taken along the line 6-6 in FIG. 5.

With reference to the attached drawings, and specifically referring to FIG. 1, a construction element 100 comprises a body member 101 and four coupling members (102, 104, 106 and 108). A detailed isometric view of the coupling member 102 is given in FIG. 2. The coupling member comprises an exterior portion 110 and interior locking portion that includes two protrusions 111 and 112, and a receiving block 114. The body member of the construction element is shaped to resemble an animal, more specifically a monkey or an ape, whereas the exterior portions of the coupling members are shaped to resemble hands and feet. Two engaging construction elements (100 and 100*a*) are shown in FIGS. 3 and 4, in plain and side views respectively, the arrows indicating the theoretical direction in which the construction elements need to traverse in order to connect to each other. The coupling members of each element are positioned at distance "a" from each other in the horizontal, and at double the distance "a" in the vertical direction. The distance "a" will be hereafter referred to as standard unit distance. FIGS. 5 and 6 illustrate in detail the preferred execution and the function of the coupling members.

Referring to FIG. 5, the coupling member 108*a* belonging to the construction element 100*a* has a coordinate system X2Y2Z2 associated thereto, wherein the positive direction of the Y2-axis is the direction along which the mating coupling member 102 needs to traverse in order to connect to coupling member 108*a*. This direction, regardless of the positive or negative sign, is hereafter referred to as coupling direction. The origin of the coordinate system X2Y2Z2 represents the center of the coupling member. The exterior portion of the coupling member 108*a* resembles a C-shape in the X2Y2 plane. Two substantially spherical protrusions 121 and 122 are appended to the inner side of the exterior portion, at the ends of the two wings of the C-shape. The centers of the two spheres that substantially define the spherical protrusions lie in the X2Y2 plane, at distance "e" from the X2Z2 plane in the negative Y2-axis direction. The protrusions 121 and 122 are symmetrical to each other with respect to the Y2Z2 plane, whereas their centers are positioned at distance "c1" from the same.

The receiving block 124 is positioned on the positive side of the Y2-axis and is integrally connected to the exterior portion of the coupling member. Two spherical recesses 125 and 126 (both seen in the sectional view shown in FIG. 6) are formed in the receiving block, the diameters of the spheres that define the recesses being substantially the same as the diameters of the protrusions 121 and 122. The centers of the spherical recesses 125 and 126 lie in the Y2Z2 plane and are positioned at the same distance "e" from the X2Z2 plane. The recesses are symmetrical to each other with respect to the X2Y2 plane, whereas their centres are positioned at distance "c2" from the same. The receiving block further comprises four guiding walls, two of which are referenced as 127 and 128 in FIG. 5, the other two being symmetrically disposed on the other side of the coupling member relative to the X2Y2 plane. The walls are being erected along both the positive and the negative directions of the Z2-axis, beginning in the vicinity of the X2Z2 plane. At the beginning, the distance between the two walls is substantially bigger than the diameter of the spherical protrusions. The distance reduces along the positive Y2-axis direction, and the walls ultimately merge with the periphery of the spherical recesses 125 and 126. As shown in the sectional view in FIG. 6, the receiving block 124 also includes a tapered portion 129 in the area between the centre of the coupling member on one, and the recessed area on the other side.

Figure 7:
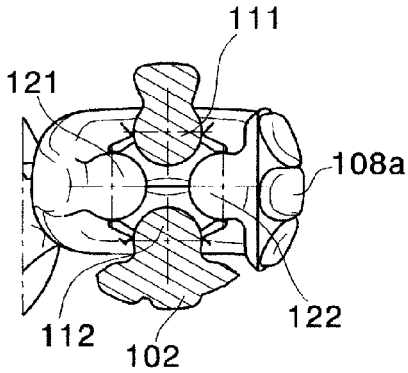
FIG. 7 is a sectional view taken along the line 7-7 in FIG. 5.

The engaging coupling member 102 is identical in shape to the coupling member 108*a*. Its two protrusions and receiving block are marked as 111, 112, and 114 correspondingly in FIG. 6. In order to connect to coupling member 108*a*, coupling member 102 needs to be oriented such as the X1Y1 plane composes a 90-degree angle with respect to the X2Y2 plane. When coupling members 108*a* and 102 are moved towards each other along the coupling direction, the protrusions 111 and 112 of coupling member 102 pass between the protrusions 121 and 122 of coupling member 108*a*, and vice versa, as illustrated in FIG. 7. In reality, for the player this serves as a visually and sensory pleasant primary alignment between the coupling members, which facilitates the further engagement.

From the moment, when the centers of the four protrusions reach a common plane and start to move away from each other, the receiving blocks 124 and 114 of coupling members 108*a* and 102, respectively, provide secondary alignment means. The tapered portion 129 of the receiving block 124 penetrates between the protrusions 111 and 112 of the opposite coupling member, limiting any misaligning rotation of coupling member 102 in the X1Y1 plane. At the same time, the guiding walls limit any unwanted side movement of the protrusions in the Y1Z1 plane and guide them towards the recesses 125 and 126. All of the above occurs at the same time relative to receiving block 114, which guides the opposite protrusions 121 and 122 toward the corresponding recesses. Hence, the coupling system is substantially self-aligning and requires minimal alignment efforts on the part of the player.

In order to reach the final position, the protrusions 111 and 112 must pass through the point of maximum thickness of the tapered portion 129. Due to the fact that the maximum half-thickness of the tapered portion (distance "g2" in FIG. 6) is bigger than the half-distance between the protrusions 111 and 112 ("g1"), the later must move away from each other to compensate for the difference. This is provided for by an elastic deflection of the wings of the exterior portion. With further application of force, protrusions 111 and 112 retract back and engage into recesses 125 and 126 in the final phase of the coupling process. Simultaneously, protrusions 121 and 122 of coupling member 108*a* engage into the corresponding recesses of coupling member 102 in the same manner as described above, and the process is associated with a pleasant snap-fit effect.

Figure 8:
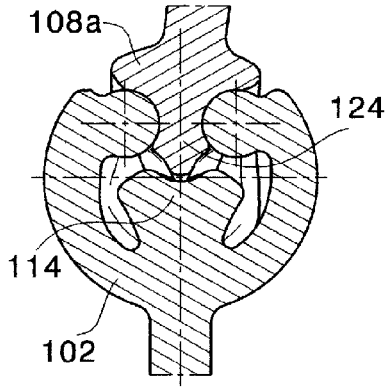
FIG. 8 is a sectional view taken along the line 6-6 in FIG. 5 wherein the coupling members are represented in coupled position.

The system is not sensitive to excessive force being applied to the coupling members. As seen in FIG. 8, which shows the coupled position of the two coupling members in a cross-section, a further application of force will bring the receiving blocks 114 and 124 in contact at the common centre of the coupling members. This prevents unwanted further deformation of or damage to the flexible exterior portion wings in case an excessive force is continuously applied after the locked position has been reached. Preferably, the distance "c1" (FIG. 6) is slightly smaller than distance "c2", which means that the protrusions remain elastically deformed in locked position, the additional resilient force providing for a more stable connection. The stability of the connection is proportional to the amount of force needed by the player to achieve the connection. Depending on the desired application of the coupling system, both can be easily adjusted by manipulating some of the geometric parameters such as the dimensions c2, c1, g2, or g1. The connection achieved by the construction system is stable, maintained by four resilient force resultants acting in two perpendicular planes, each at distance "e" from the center of the coupling members. Decoupling or disconnection of the coupling members can basically be achieved only if a decoupling force is applied substantially along the coupling direction. In other cases, assuming as an example that a moment about the Z2-axis is applied to the system (force along the positive Z1 axis applied to coupling member 102 offset from the centre), a hinging effect is produced about the line connecting the centers of recesses 124 and 125. While protrusions 121 and 122 resist firmly any relative rotation by having the receiving block 114 in between, the only possible way for disengagement is that protrusions 111 and 112 jump out of the recesses 124 and 125 through the guiding walls. Due to the substantial deformation needed for the above, relatively high force is needed to break the connection. Therefore, it is very unlikely that the connection breaks by application of force along a direction that is substantially different than the coupling direction. The system is suitable for application where relatively many elements are to be connected into a stable structure.

For the functionality of the system, the shape of the exterior portion is of no other relevance except that it integrally connects the interior locking means to the exterior portion and thereby provides the needed resilient force for the deflection and retraction of the protrusions. Generally, any shape that forms an open loop by connecting the protrusions to the receiving block is possible, as long as the loops of two engaging coupling members do not interfere physically. Depending on stylistic factors or on desired application, the exterior portion can take various shapes as will be shown further in this disclosure.

The coupling members can be easily manufactured separately or integrally with the construction element. Preferably, they are made of thermosets, thermoplastics or similar resilient materials.

Figure 9:
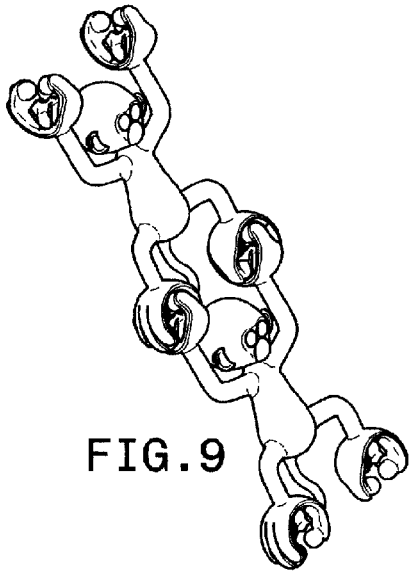
FIG. 9 is an isometric view of two monkey-like construction elements connected to each other.

FIG. 9 shows the construction elements 100 and 100*a* in an assembled position. The connection can occur simultaneously for both pairs of coupling members or, individually, one by one, depending on the wishes and the skills of the player.

Alternative Preferred Embodiments

Figure 10:
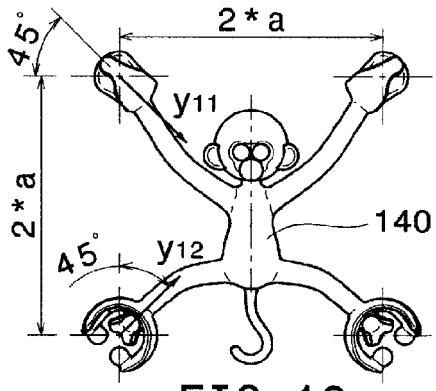
FIG. 10 is a front view of a monkey-like construction element with alternatively distributed coupling members.

Another similar construction element 140 is shown in FIG. 10, wherein the four coupling members are positioned at 2 times the unit distance "a" in horizontal and vertical direction, and the coupling directions are oriented at 45-degree angles with respect to the horizontal and vertical direction. This is illustrated with the axes y11 and y12 in FIG. 10, the opposite coupling members being symmetrical with respect to the vertical centerline.

Figure 11:
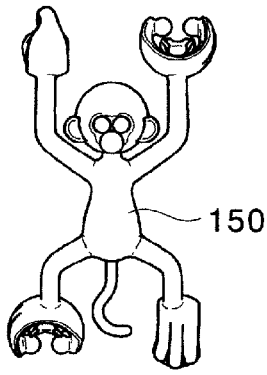
FIG. 11 is a front view of another monkey-like construction element having alternatively distributed coupling members.
Figure 12:
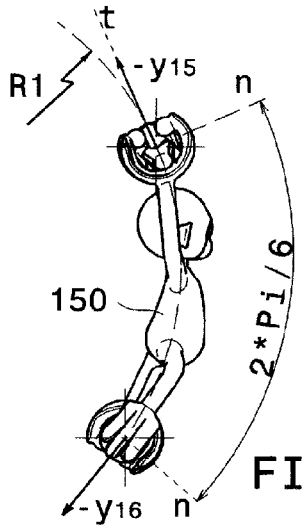
FIG. 12 is a side view of the construction element shown in FIG. 11.

FIGS. 11 and 12 depict another construction element 150. As seen in the side view (FIG. 12), the centers of the four coupling members are positioned on a circle with radius R1 and compose an angle of 60 degrees, the coupling directions y15 and y16 being tangent to the same circle.

Figure 13:
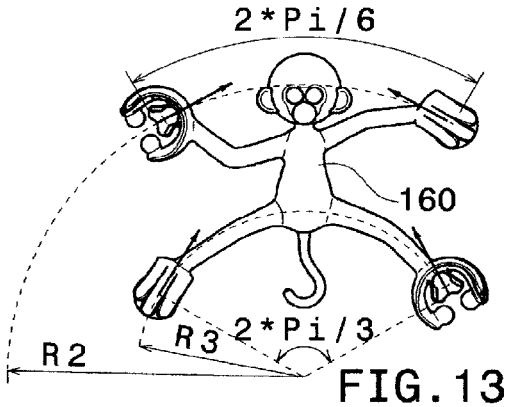
FIG. 13 is a front view of another monkey-like construction element having alternatively distributed coupling members.

FIG. 13 illustrates a construction element 160 where the centers of the upper two coupling members lie on a first circle with radius R2 and compose an angle of 60 degrees, while the centers of the lower two coupling members lie on a second circle with radius R3 and compose an angle of 120 degrees. The coupling directions of all four coupling members are tangent to the corresponding circle.

Figure 14:
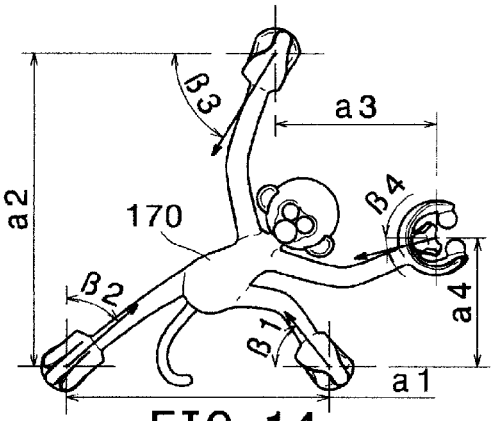
FIG. 14 is a front view of another monkey-like construction element having arbitrarily distributed coupling members.

FIG. 14 illustrates a construction element 170 having arbitrary distances "a1" to "a4" between the coupling members, each coupling direction composing an arbitrary angle β1 to β4) with respect to the horizontal or vertical references.

Figure 15:
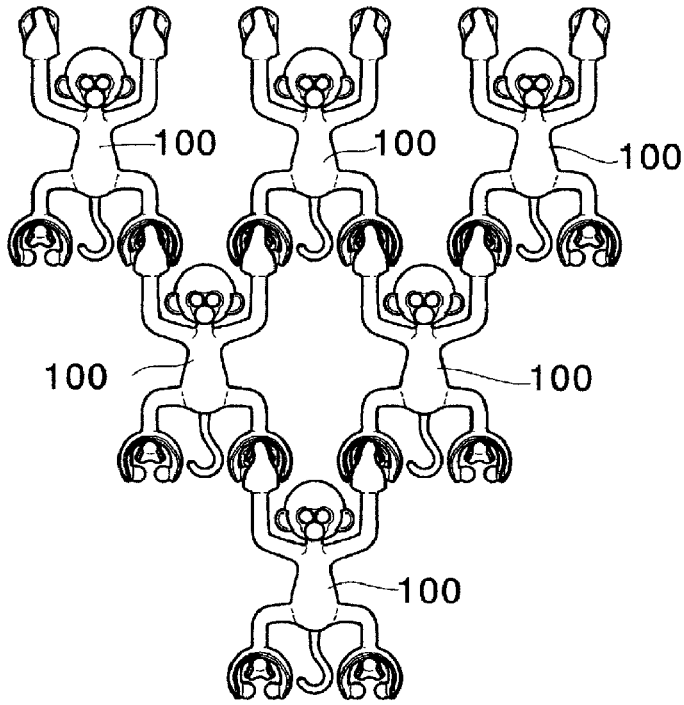
FIG. 15 is a front view of an open-end structure comprising a plurality of the monkey-like construction elements as shown in FIG. 1.
Figure 16:
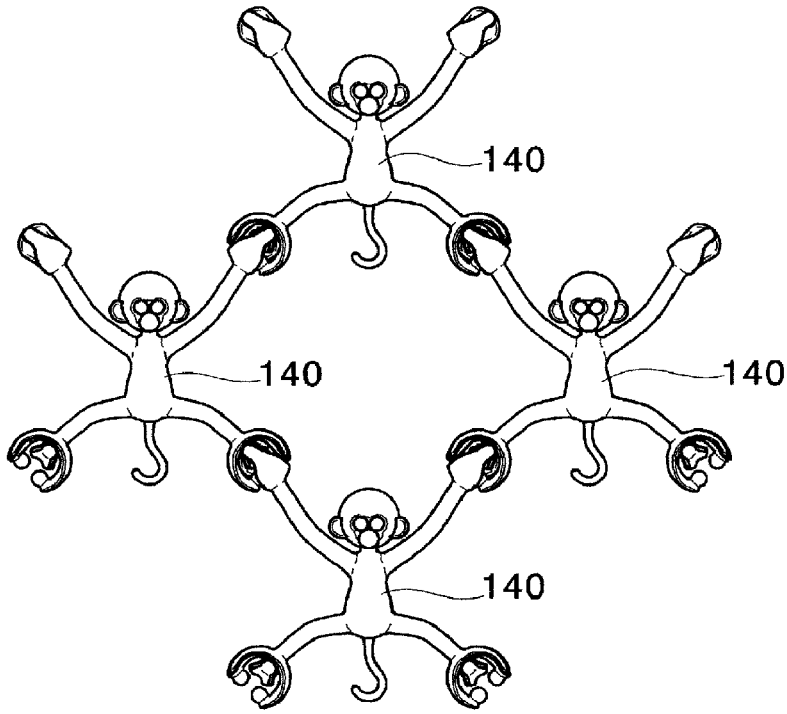
FIG. 16 is a front view of an open-end structure comprising a plurality of the monkey-like construction elements as shown in FIG. 10.

FIGS. 15 and 16 illustrate examples for an application of the elements 100 (FIG. 15) and 140 (FIG. 16) in open-end construction sets.

Figure 17:
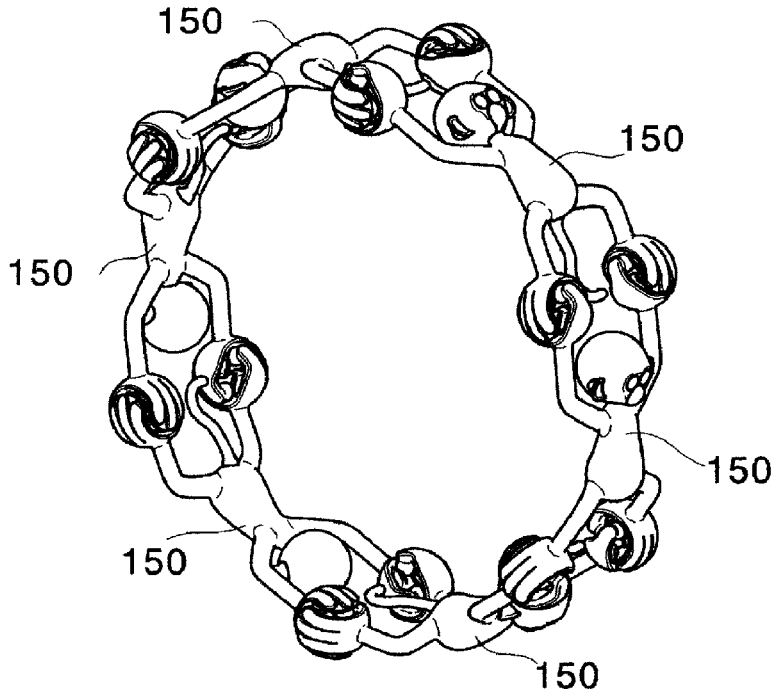
FIG. 17 shows a construction set wherein the plurality of elements are interconnected to form a closed cylinder-like structure.

FIG. 17 illustrates a playing set comprising six construction elements 150 that can be joined together to form a closed geometric shape, the meaning of "closed geometric shape," hereafter being that all coupling members within the set have been connected to one another, leaving no single coupling member in uncoupled state. In order to assemble the last element, the rest of the structure needs to deflect to provide space for the insertion of the last pair of coupling members, which is easily achieved due to the general elasticity of the construction elements and the formed structure in general.

Figure 18:
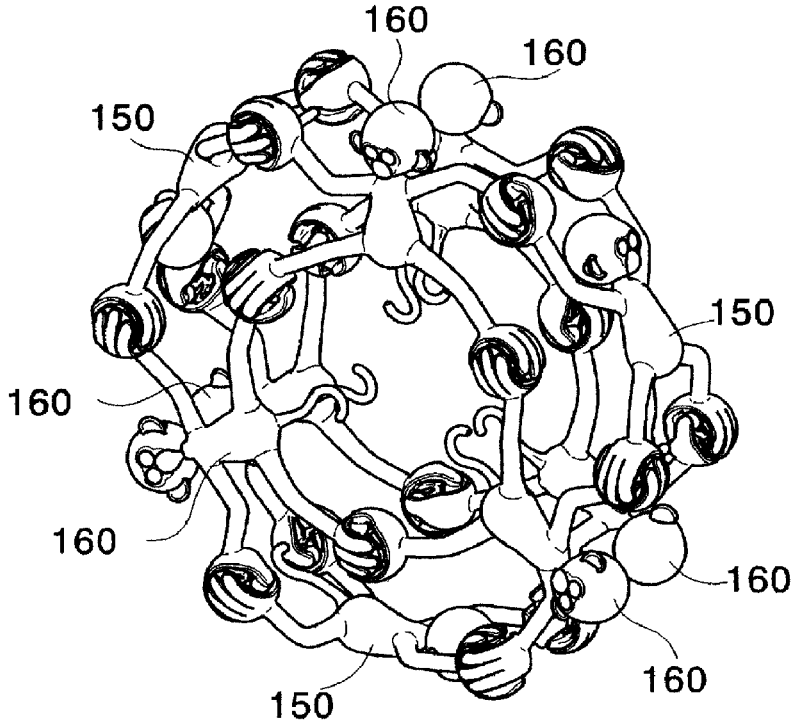
FIG. 18 shows a construction set wherein the plurality of elements are interconnected to form a closed wheel-like structure.
Figure 19:
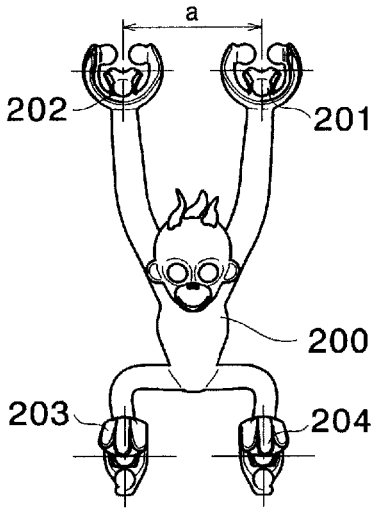
FIG. 19 is a front view of an ape-like construction element having four coupling members with coupling directions that lie in different planes.
Figure 20:
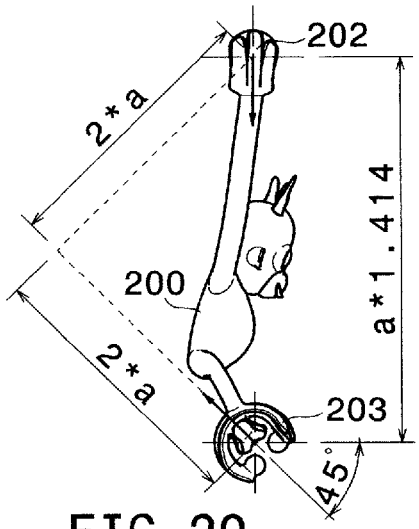
FIG. 20 is a side view of the ape-like element shown in FIG. 19.
Figure 21:
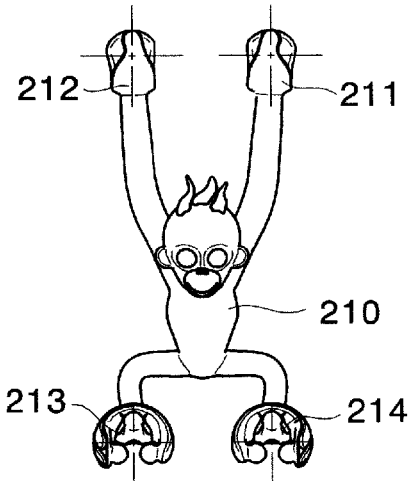
FIG. 21 is a front view of an ape-like construction element having alternatively oriented coupling members.
Figure 22:
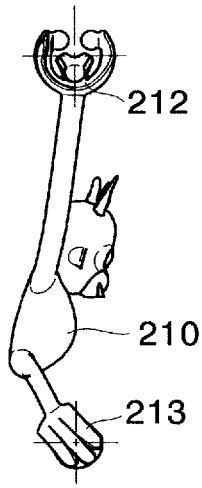
FIG. 22 is a side view of the ape-like element shown in FIG. 21.
Figure 23:
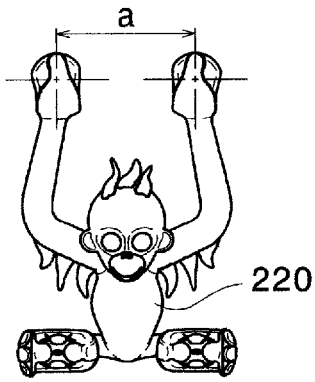
FIG. 23 is a front view of an alternative ape-like construction element having alternatively positioned coupling members.
Figure 24:
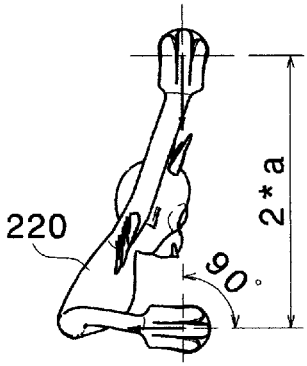
FIG. 24 is a side view of the ape-like element shown in FIG. 23.

A construction set comprising six construction elements 160 and three construction elements 150 generates a cylinder-like structure resembling a wheel, as illustrated in FIG. 18. Since it requires a certain amount of imagination to assemble the individual nine construction pieces into the presented shape, especially if the wanted end-shape is not known in advance, this construction set finds its application as a puzzle. During the process of solving the puzzle, many other visually pleasant open geometric shapes can be achieved. By making the nine construction elements slightly different in shape, the puzzle becomes exponentially more difficult to be solved. This can be easily achieved by changing the positions of the individual coupling members and their orientations.

FIGS. 19 to 26 present construction elements where the coupling directions of the four coupling members lie in different planes. The construction element 200, shown in front and side views in FIGS. 19 and 20, respectively, comprises four coupling members 201 through 204 with interior portions identical to the ones previously described. The distance between the lower and upper pair of coupling members is equal to the hypotenuse of a square with a side equal to 2-times the unit length "a," while the coupling direction of the lower coupling members compose a 45-degree angle with respect to the coupling direction of the upper coupling members.

Construction element 210 (shown in FIGS. 21 and 22) is the same as construction element 200, except that the four coupling members 211 to 214 are rotated 90 degrees relative to their coupling directions. In construction element 220 depicted in FIGS. 23 and 24, the coupling directions of the lower two coupling members lie in a plane perpendicular to the plane defined by the coupling directions of the upper two coupling members. By having been defined in such a manner, construction elements 200, 210 and 220 can be effectively combined with the previously described construction elements to form various shapes, as it will become apparent further in this disclosure.

Figure 25:
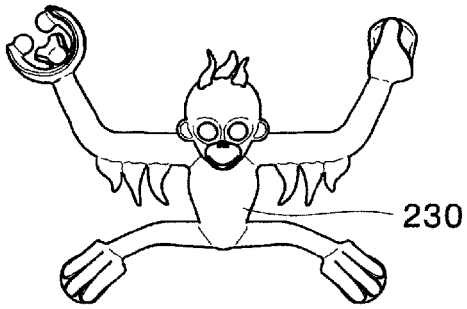
FIG. 25 is a front view of a further alternative ape-like construction element having alternatively positioned coupling members.
Figure 26:
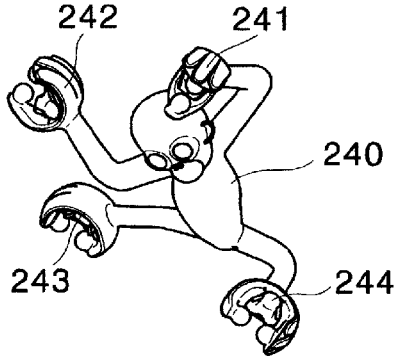
FIG. 26 is an isometric view of another ape-like construction element having alternatively positioned coupling members.

FIG. 25 shows construction element 230 where the coupling members are arbitrarily positioned. In FIG. 26, the coupling directions of coupling members 242 and 243 define a first plane, whereas the coupling directions of coupling members 241 and 244 lie in planes perpendicular to each other and perpendicular to the said first plane at the same time.

Figure 27:
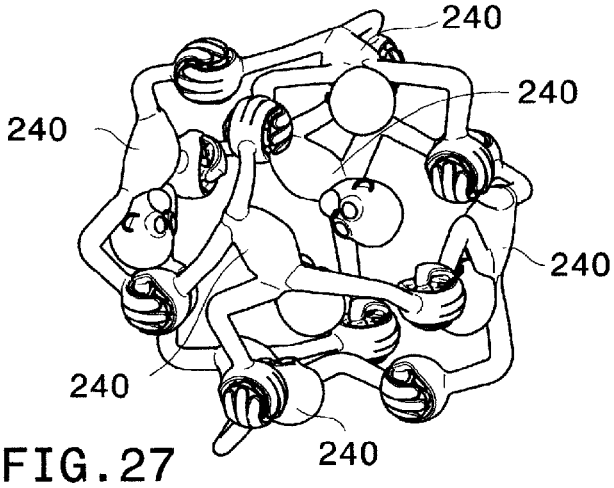
FIG. 27 is an isometric view of a construction puzzle wherein the plurality of elements are interconnected into a cubical shape.
Figure 28:
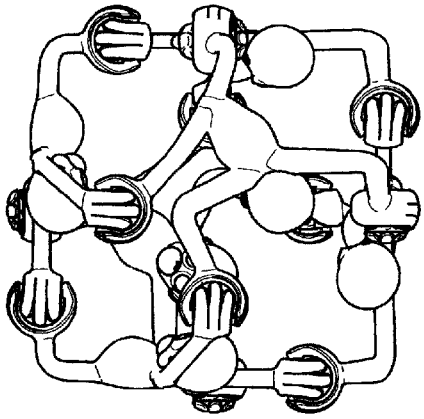
FIG. 28 is a front view of the construction puzzle as shown in FIG. 27.

An application of construction element 240 in a construction puzzle is shown in FIGS. 27 and 28 in isometric and front views respectively, wherein six elements are interconnected to form a cube-like geometric shape.

Figure 29:
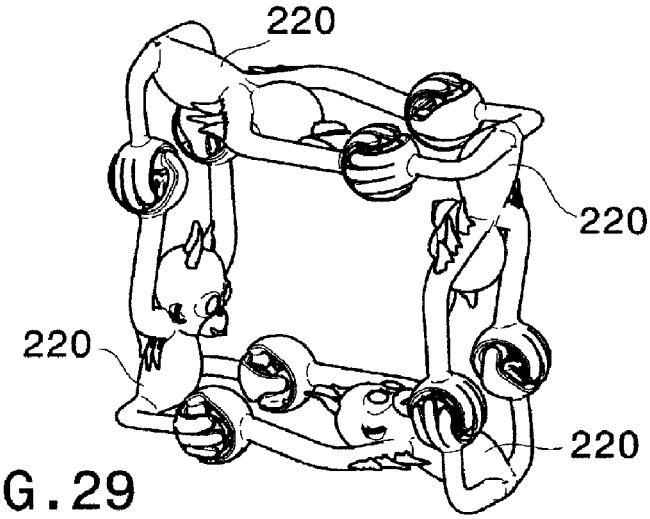
FIG. 29 shows a construction set wherein the plurality of elements are interconnected to form a closed rectangular structure.
Figure 30:
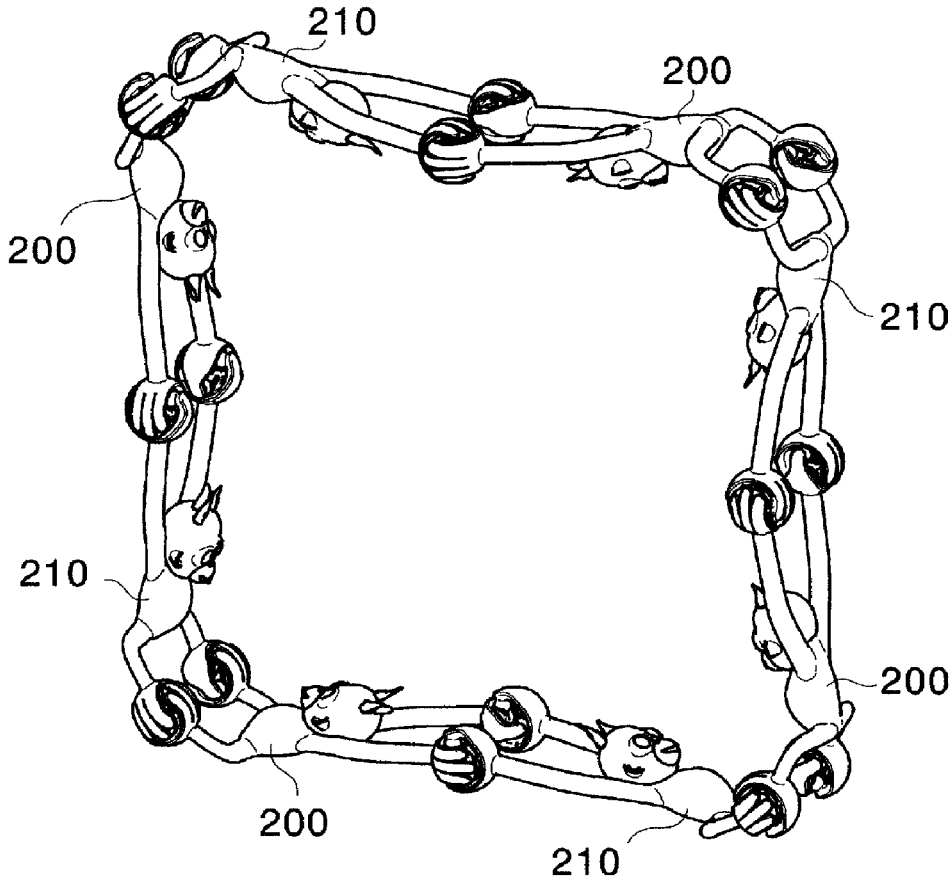
FIG. 30 shows another construction set wherein the plurality of elements are interconnected to form a closed rectangular structure.
Figure 31:
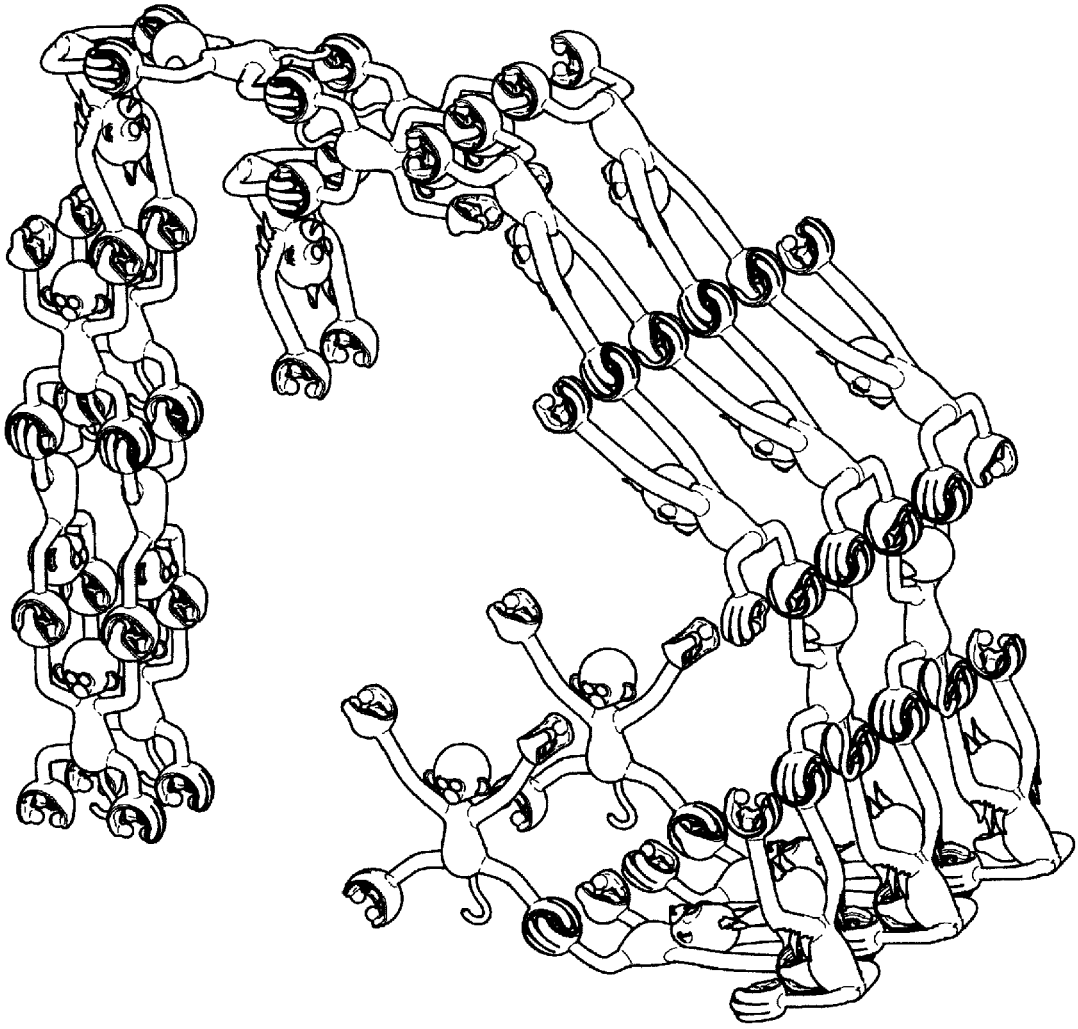
FIG. 31 shows a construction set wherein the plurality of elements are interconnected to form an arbitrary open-end structure.

FIGS. 29 and 30 show rectangular geometric shapes being formed by construction element 220 (FIG. 29), and by construction elements 200 and 210 (FIG. 30). Another example of interconnecting some of the previously described construction elements in an open-end structure is given in FIG. 31.

Figure 32:
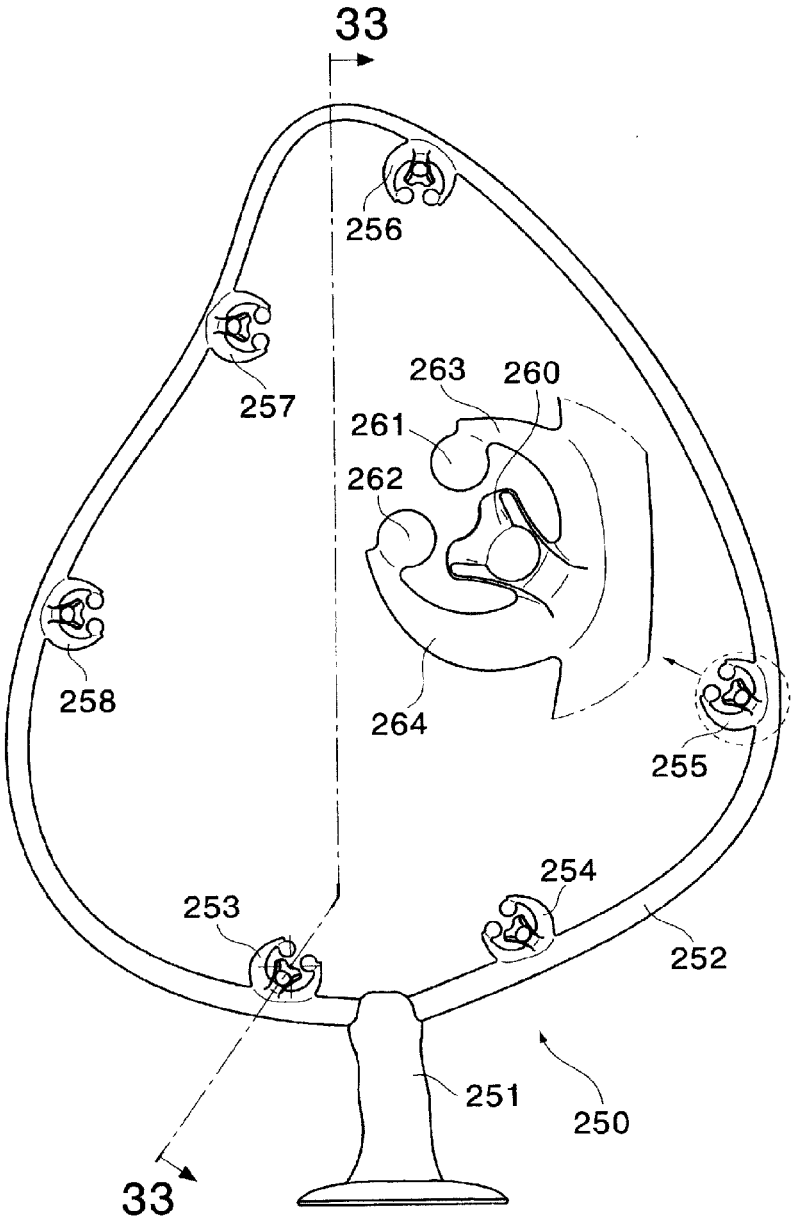
FIG. 32 is a front view of a tree-like support element adapted to receive a plurality of construction elements.
Figure 33:
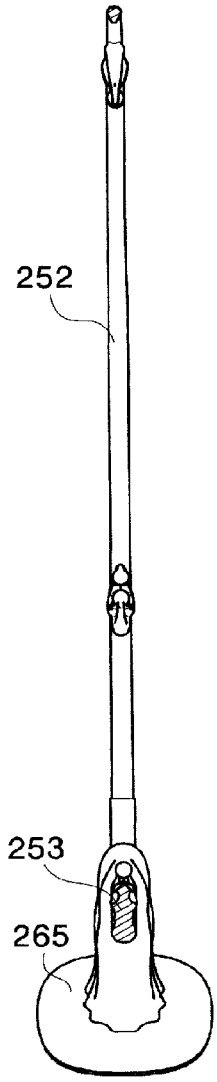
FIG. 33 is a sectional view taken along the lines 33-33 in FIG. 32.

FIGS. 32 and 33 illustrate a support element 250 resembling a tree and adapted to receive a plurality of other construction elements in its interior. It comprises a trunk 251, a peripheral frame 252 connected thereto, and a planar portion 265 for placing the support element on a playing surface. The peripheral frame forms a closed loop and further comprises six integrally formed coupling members (253 through 258) on the inner side. The coupling member 255 shown in the enlarged view includes two wings 263 and 264 that form a loop and hold the interior locking means. The protrusions 261 and 262 and the receiving block 260 are identical to the ones of the previously described elements. Hence, the support element 250 can be used as a base for connecting other construction elements.

Figure 34:
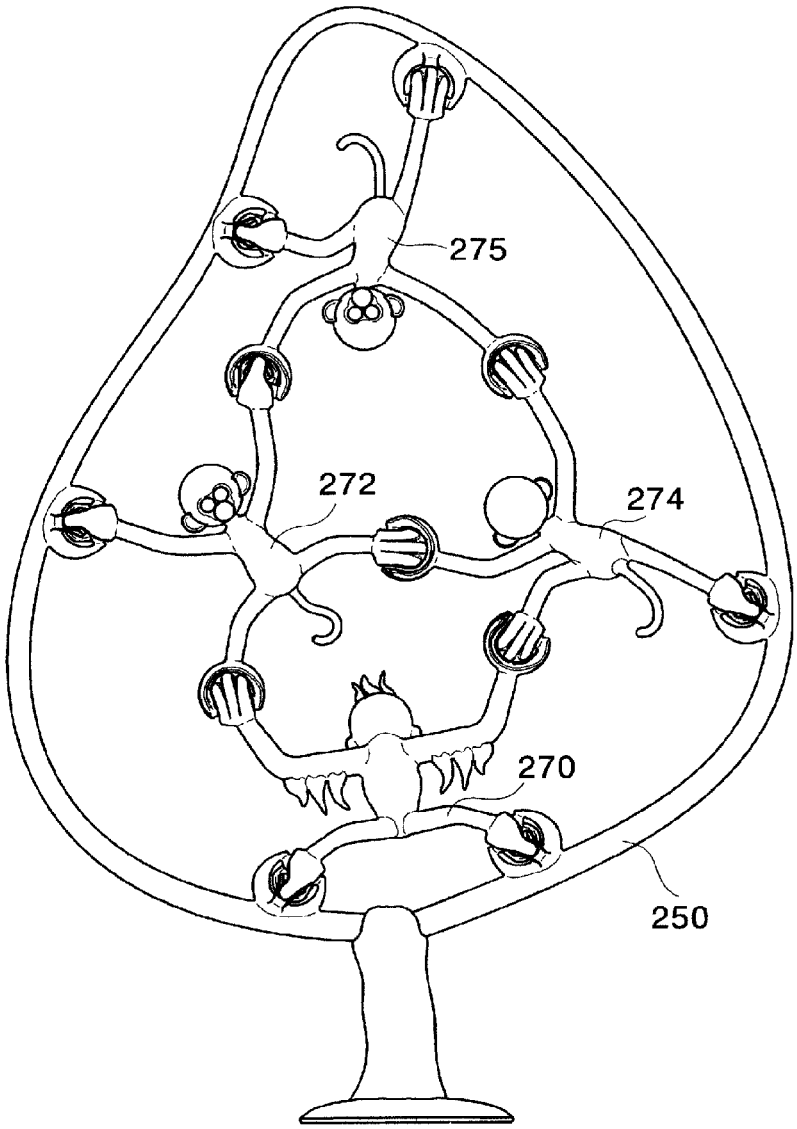
FIG. 34 is a front view of a construction puzzle comprising a tree-like support element and a plurality of construction elements.
Figure 35:
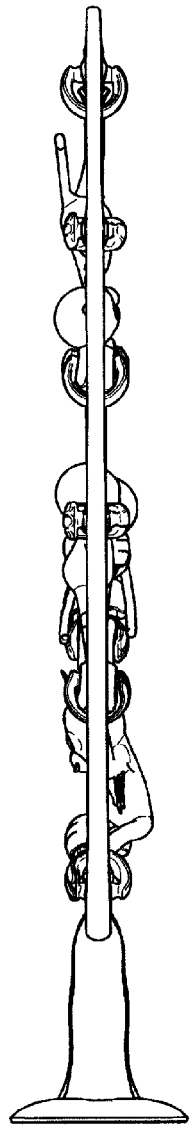
FIG. 35 is a side view of the construction puzzle as shown in FIG. 34.

In FIGS. 34 and 35, construction elements 270, 272, 274 and 275 are connected to the support element 250, as well as to each other, to form a closed geometric shape. Finding the right way to join the elements becomes even more challenging if the number of interconnecting elements in such a construction puzzle is increased.

FIG. 36 shows another tree-like support element 280 used as a base for connecting other construction elements. It includes a planar portion 281 suitable for placing the element on a playing surface and eight coupling members (282, 284, 286, 288, 290, 292, 294 and 296) arranged in pairs along four radial directions substantially parallel to the planar portion 281. Each coupling member is shaped so as to resemble an open coconut or other fruit, and includes the identical standard locking means in the interior, as illustrated in FIG. 37 with the reference numbers 297, 298 and 299 belonging to the coupling member 284. The support element 280 can serve as a playing board for playing board games. In one variation, four players are assigned one side of the board each and in turn can append new elements only as a continuation of their "own" structure. The players having opposite board sides play in a team, and their goal is to make a connection with their elements, while the other team tries to do the same preventing the first team from succeeding. Since each way of connecting the opposite board sides must pass through the other team's area, interesting combinations can be achieved. By changing or adding other simple rules, other types of games can be played, which is out of the scope of this disclosure, but is obvious to the ones skilled in the art.

Figure 38:
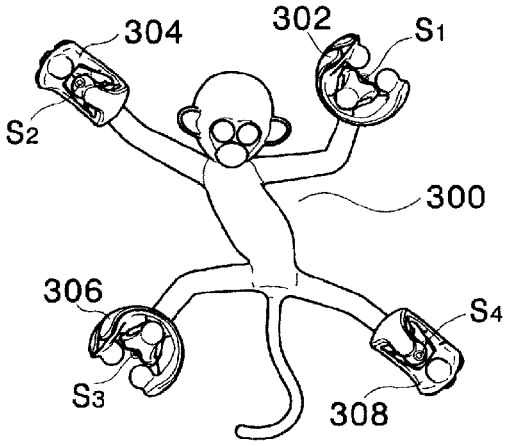
FIG. 38 is a front view of a monkey-like construction element wherein a common sphere defines the positions and the orientations of the individual coupling members.
Figure 39:
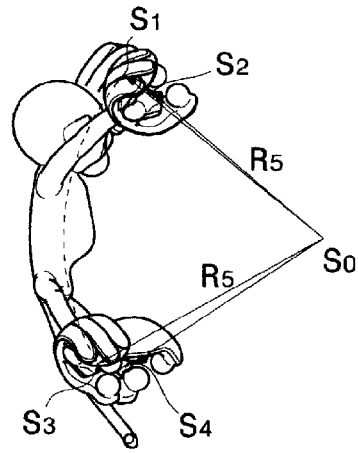
FIG. 39 is a side view of the construction element shown in FIG. 38.
Figure 40:
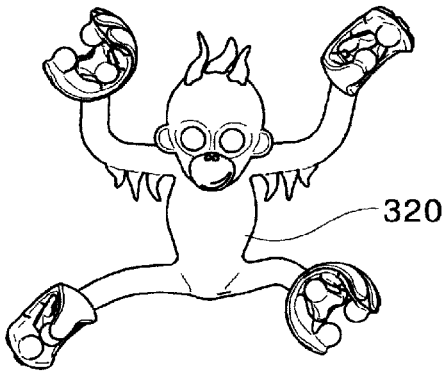
FIG. 40 is a front view of an ape-like construction element wherein a common sphere defines the positions of the coupling members.
Figure 41:
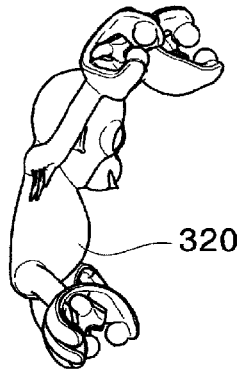
FIG. 41 is a side view of the construction element shown in FIG. 40.

FIGS. 38 and 39 show another construction element 300 comprising four coupling members (302,304,306 and 308), their respective centers S1 through S4 lying on a common sphere with centre S0 and radius R5. The body member of the element 300 is curved to generally depict the curvature of the common sphere. In FIGS. 40 and 41, a similar construction element 320 is shown, but the shape of the body member and the orientation of the couplings are different.

Figure 42:
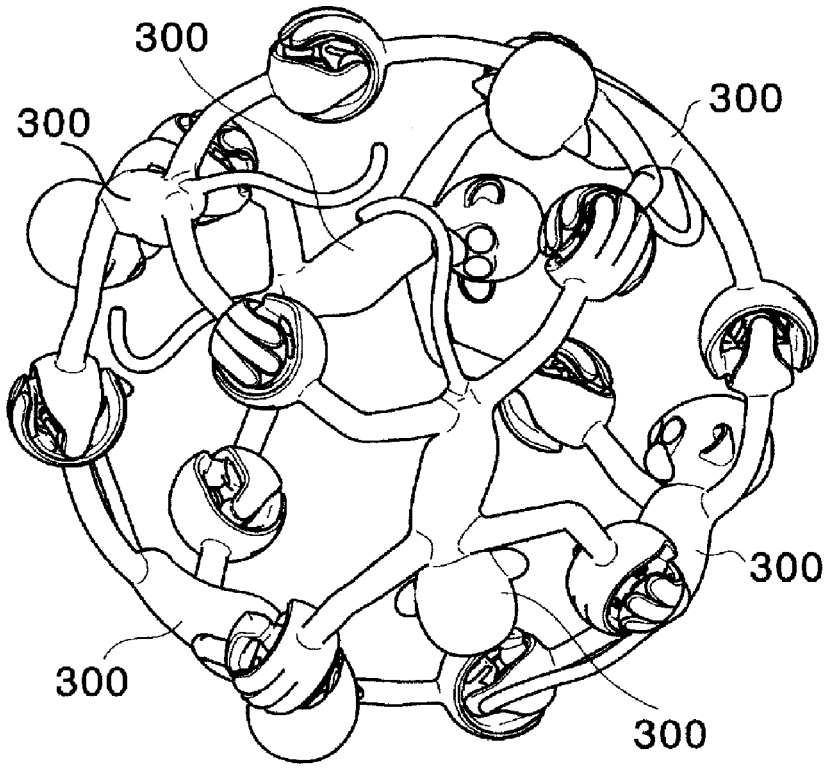
FIG. 42 is an isometric view of a construction puzzle wherein the plurality of elements are interconnected to form a sphere.

An application of element 300 in a construction puzzle set is shown in FIG. 42, where six elements are joined together to form a sphere. The elements could also be made non-identical, thereby increasing the difficulty of solving the puzzle.

Figure 43:
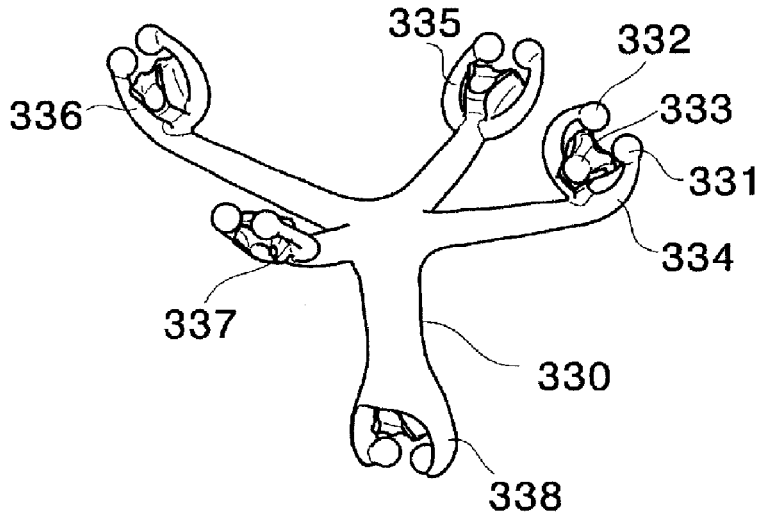
FIG. 43 is an isometric view of a tree-like construction element.

The construction element 330 shown in FIG. 43 includes a body member shaped like a tree-trunk with four branches. Five coupling members (334, 335, 336, 337 and 338) are attached at the ends, each coupling member containing the standard interior locking portion. This is illustrated by the referenced protrusions 331 and 332 and receiving block 333 belonging to coupling 334.

Figure 44:
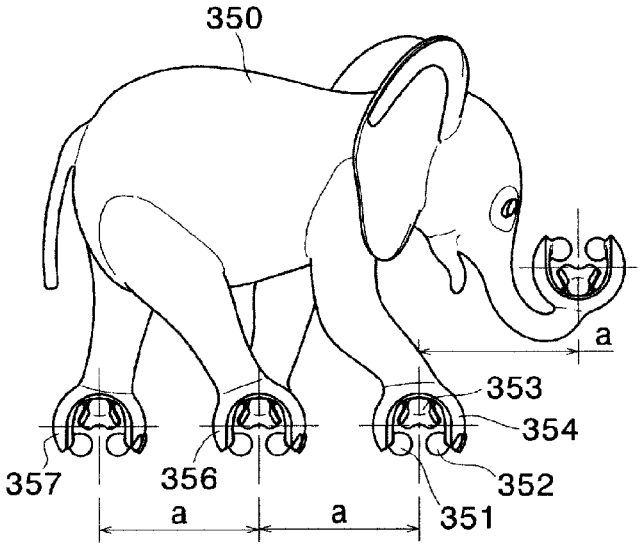
FIG. 44 is a side view of an elephant-like construction element.
Figure 45:
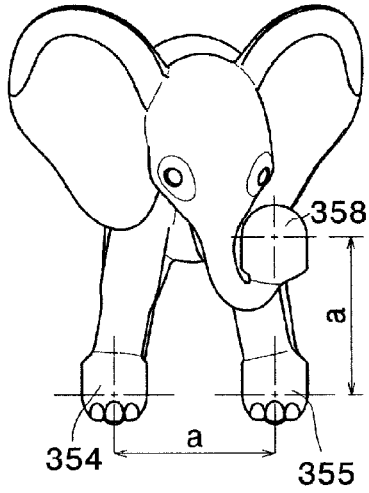
FIG. 45 is a front view of the element shown in FIG. 44.

FIGS. 44 and 45 show a construction element 350 resembling an elephant, wherein the exterior portions of coupling members 354 through 358 are shaped so as to resemble the feet and the tip of the trunk. The interior portions of the coupling members include the standard interlocking means. As an example, coupling member 354 includes two protrusions (351 and 352) and a receiving portion 353. The coupling members are arranged three-dimensionally relative to three orthogonal directions: the two horizontal directions referenced in the provided side and front views respectively, and one vertical direction. Measured along any of the three defining orthogonal directions, the distance between any two coupling members (their centers specifically) is an integer multiple of the distance unit "a."

Figure 46:
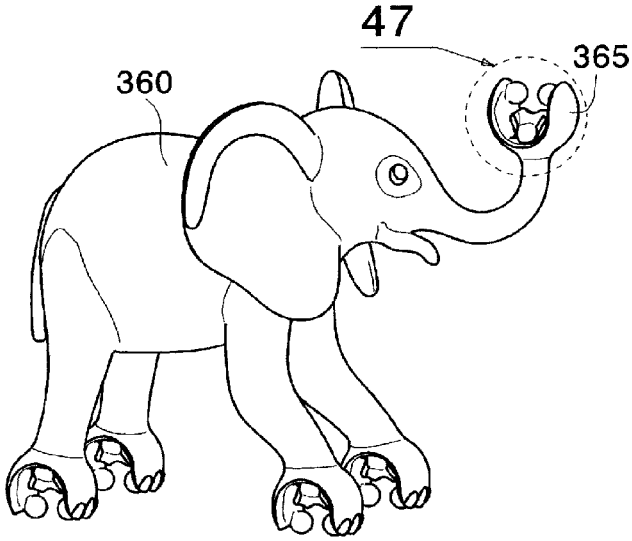
FIG. 46 is an isometric view of an alternative elephant-like element.
Figure 47:
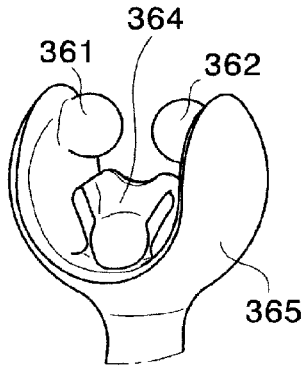
FIG. 47 is a detailed view of the area marked "47" in FIG. 46.
Figure 48:
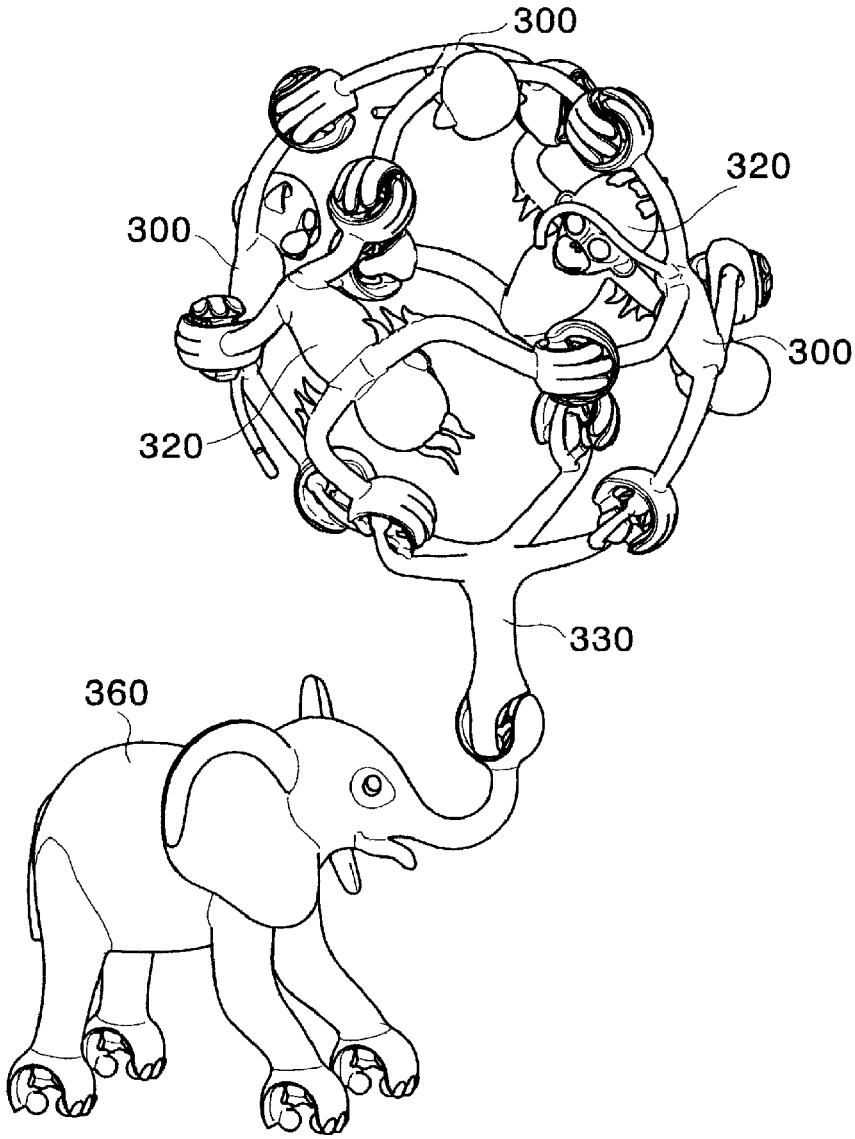
FIG. 48 shows a construction set wherein a structure of interconnected elements is held by an elephant-like element.

FIG. 46 shows another elephant-shaped construction element 360, with an alternative positioning of the coupling members, whereas the trunk tip coupling member 365 and the integrally built locking portion features (361, 362 and 364) are shown in detail in FIG. 47. FIG. 48 represents an example of a construction set composed of construction elements 300, 320, 330 and 360. The assembled structure may also serve as a decorative item for a work table, shelf or alike.

Figure 49:
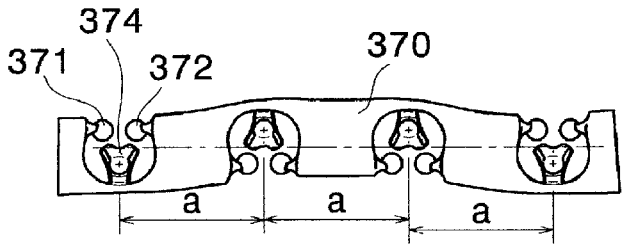
FIG. 49 is a front view of a timber-like construction element.

A log-shaped construction element 370 given in FIG. 49 includes four U-shaped cutouts where interior locking features 371, 372 and 374 are attached. Hence, four coupling members are formed within the U-shaped recesses. The remaining cross-sectional area of the element at the cutouts is dimensioned as to provide sufficient elasticity needed for proper functioning of the four coupling members.

Figure 50:
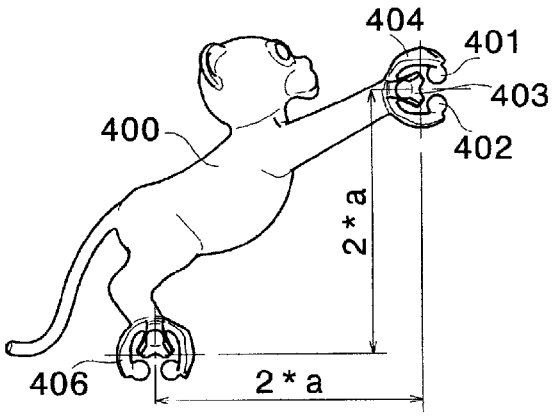
FIG. 50 is a side view of a cat-like construction element.
Figure 51:
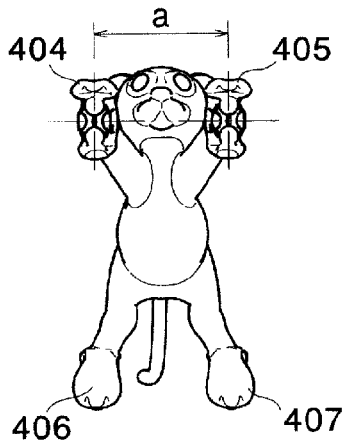
FIG. 51 is a front view of the element as shown in FIG. 50.

FIGS. 50 and 51 are side and front views of a construction element 400 resembling a tiger or other big cat. The exterior portions of coupling members 404 through 407 resemble the animal's paws, while the interior locking portion is composed of standard spherical protrusions 401 and 402 and receiving block 403. The coupling directions of the upper coupling members are perpendicular to the ones of the lower coupling members.

Figure 52:
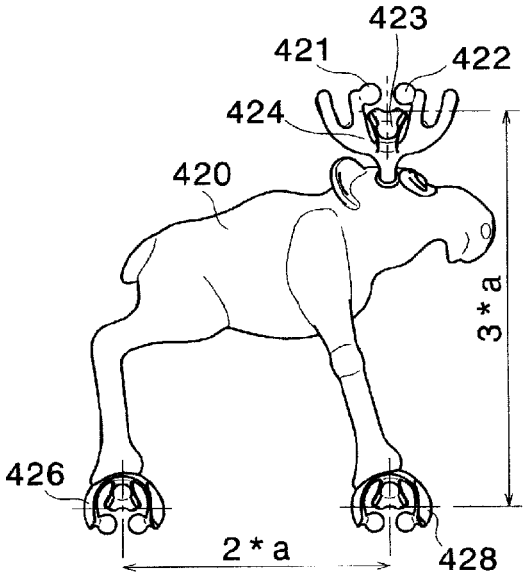
FIG. 52 is a side view of a moose-like construction element.
Figure 53:
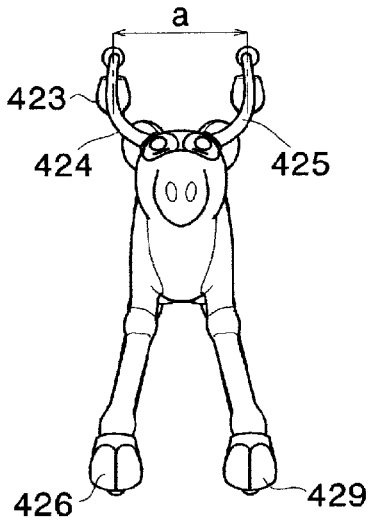
FIG. 53 is a front view of the element shown in FIG. 52.

FIGS. 52 and 53 are side and front views of a construction element 420 resembling a moose. The four hooves are shaped so as to function as exterior portions for four coupling members (426, 428, 429 and the hind left hoof that remains hidden in the views). Additionally, two coupling members are modelled as integral parts of the animal's antlers. As seen in FIG. 52, the antler branch 424 includes two spherical protrusions 421 and 422, and receiving block 423. The opposite antler branch 425 is identically built. For both construction elements 400 and 420, the distances between the centers of the individual coupling members measured along three defining orthogonal directions are integer multiples of the standard unit length.

Figure 54:
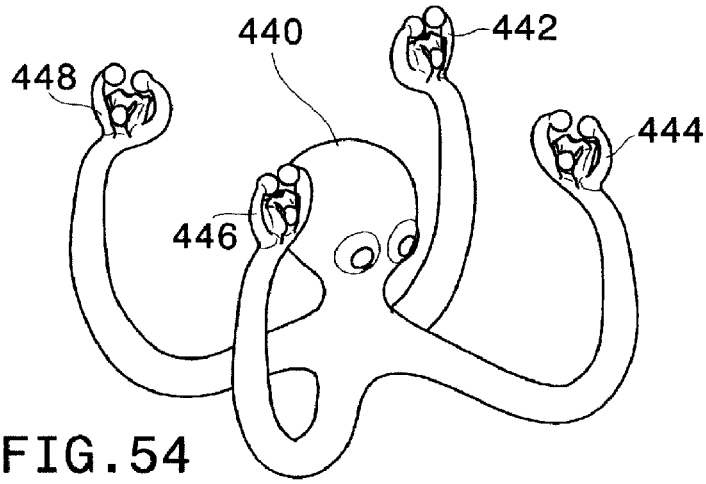
FIG. 54 is an isometric view of an octopus-like construction element.
Figure 55:
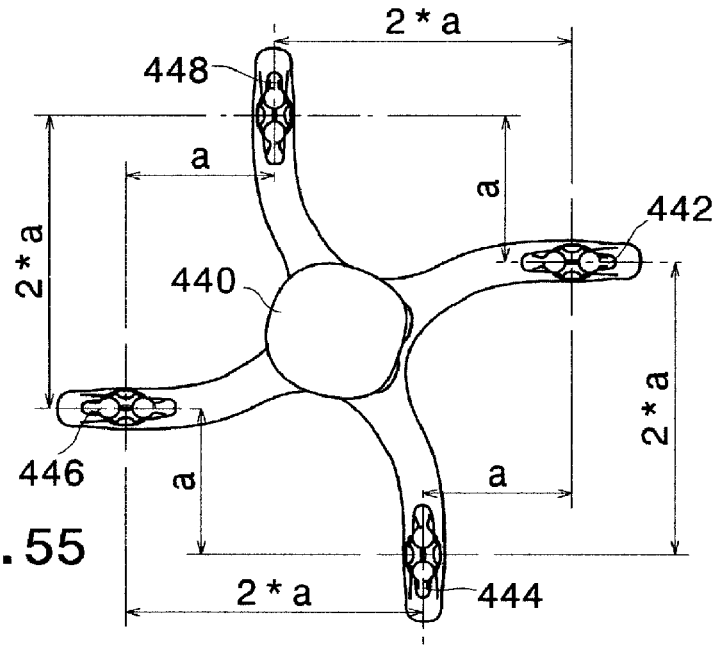
FIG. 55 is a top view of the element shown in FIG. 54.

The body member of construction element 440 (FIGS. 54 and 55) resembles an octopus, wherein the tips of the tentacles are formed as four coupling members (442, 444, 446, 448). This element could serve as a base upon which structures of other construction elements can be appended upwards.

Figure 56:
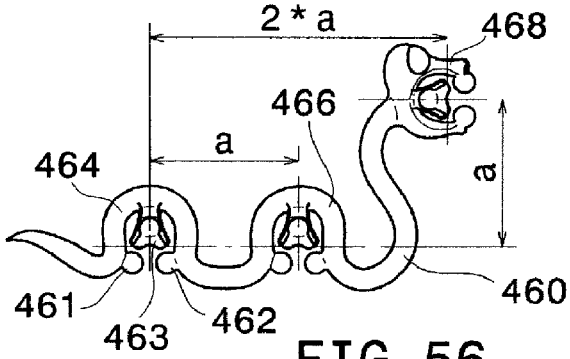
FIG. 56 is a side view of a serpent-like construction element.

The construction element 460 in FIG. 56 resembles a serpent having two U-shaped bends on the torso (464 and 466) where the interior locking features (461, 462 and 463) are positioned. The jaws of the serpent also include identical locking means in the interior. Therefore, there exist effectively three coupling members that can be used to join the construction element 460 to other elements.

Figure 57:
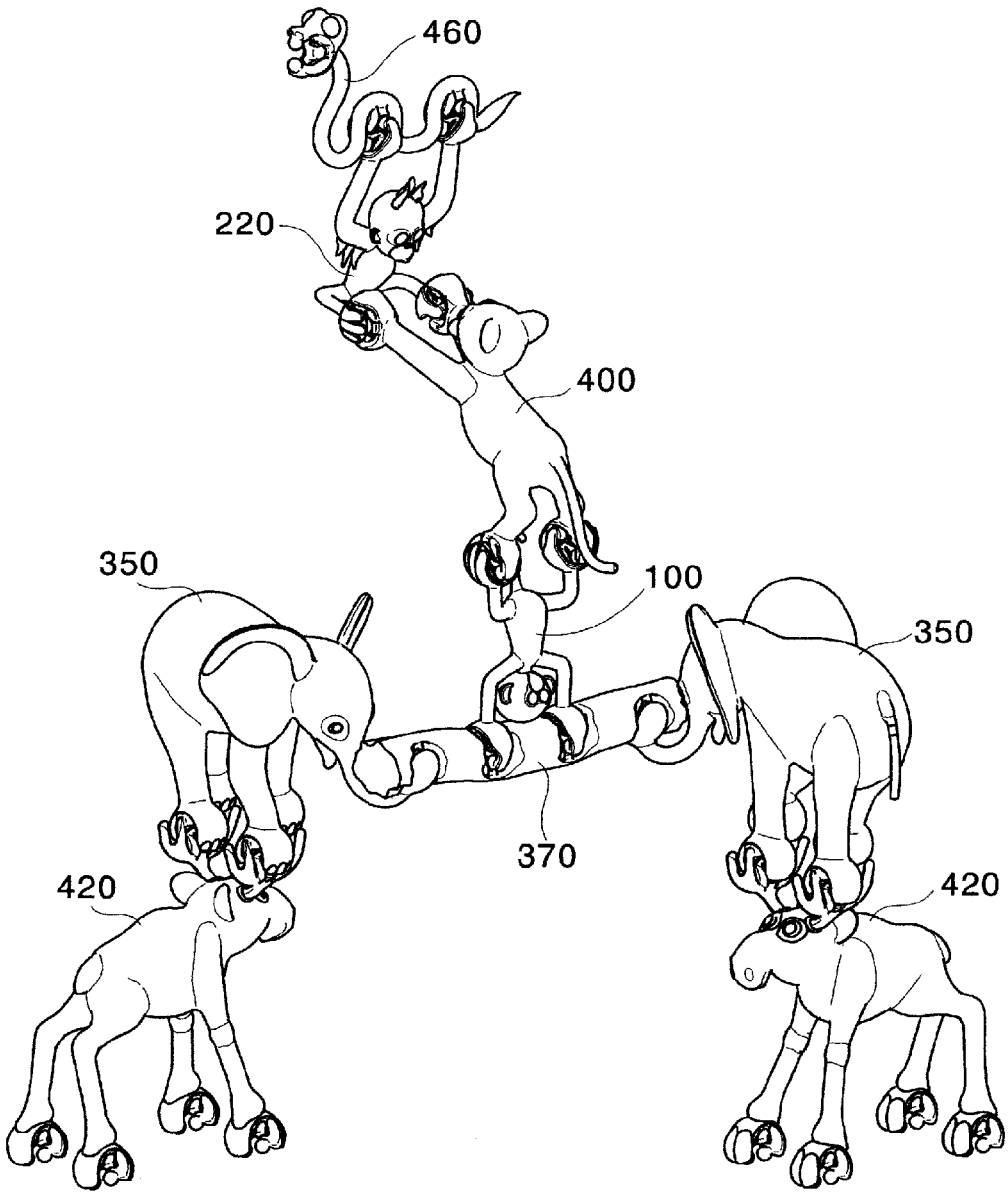
FIG. 57 shows a construction set wherein the plurality of construction elements are joined to form an arbitrary structure.

The previously described construction elements can be connected to each other in various combinations. One example of a construction structure composed of elements 420, 350, 370, 100, 400, 220 and 460 is illustrated in FIG. 57.

Figure 58:
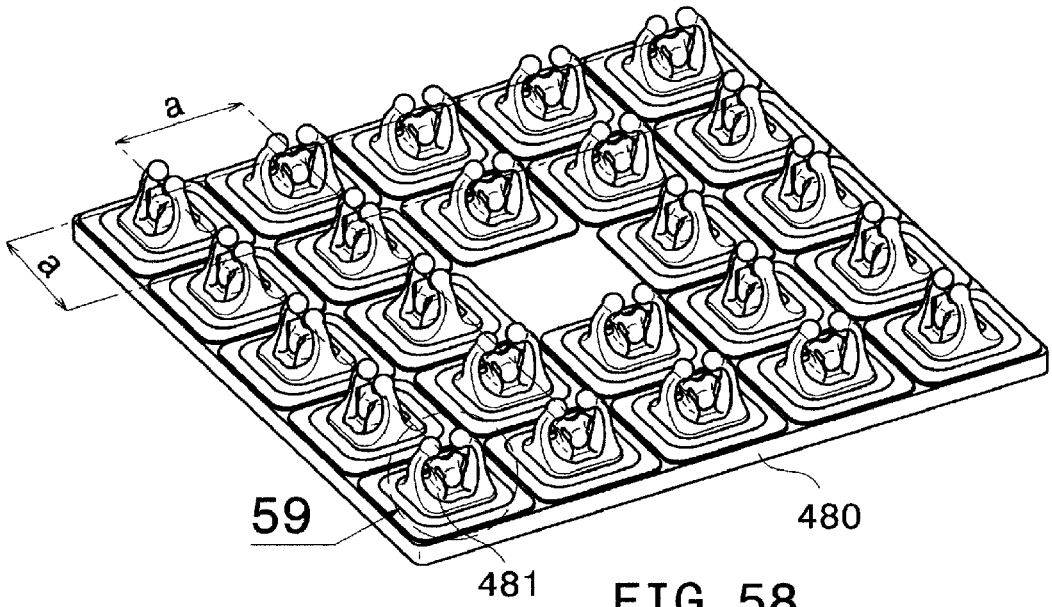
FIG. 58 is an isometric view of a board element.
Figure 59:
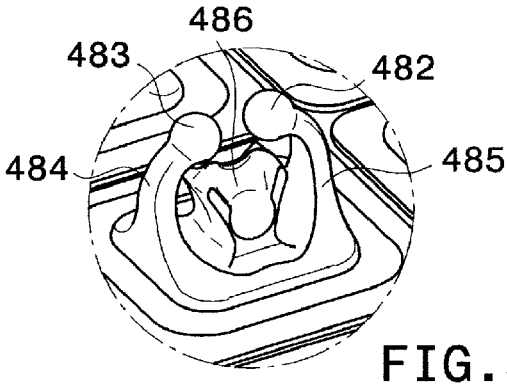
FIG. 59 is a detailed view of the area marked "59" in FIG. 58.
Figure 60:
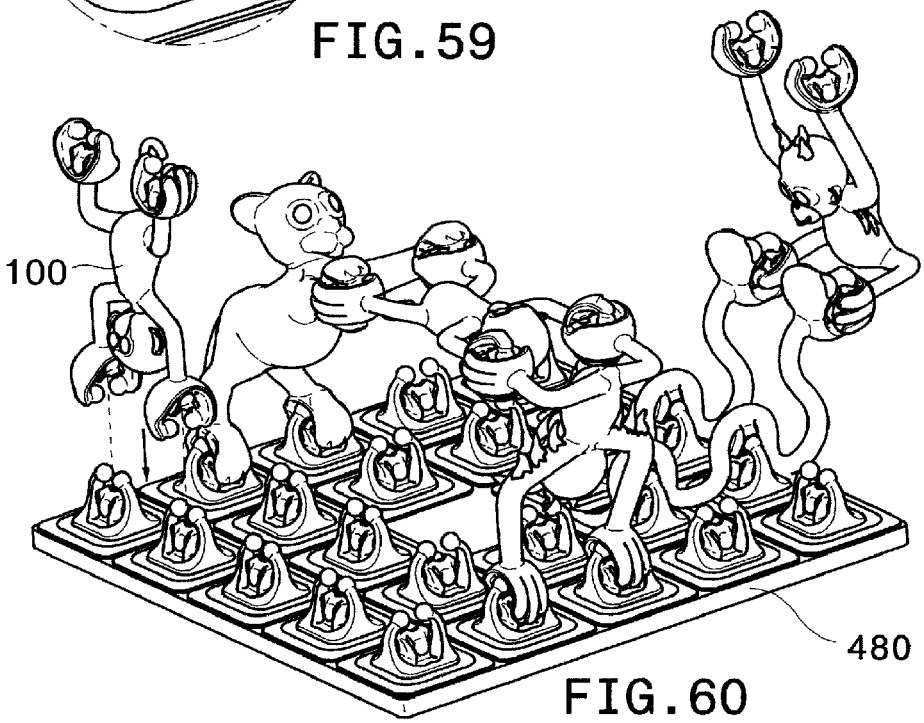
FIG. 60 is an isometric view of the board element wherein a plurality of construction elements are appended thereto.

FIG. 58 depicts a board element 480 having a planar body and twenty-four coupling members 481. A detailed view of one of the coupling members is shown in FIG. 59. Two fingers (484 and 485) erect out of the planar body of the board element and end in two spherical protrusions 482 and 483. Receiving block 486 is also attached to the planar portion of the board. Other construction elements can be appended to the board element by pressing them down, as shown in FIG. 60 with construction element 100. The distance between any two coupling members along the orthogonal directions defining the board is an integer multiple of the unit distance "a." Therefore, the construction elements can be attached to the board element in various ways, one of them shown in FIG. 60. There are different possibilities of playing board games by using the board element 480 together with a number of previously described construction elements. In one particular game, the objective of the game is to join two opposite sides of the board by using elements of choice or availability before the other parties do so. Games of this type foster the imagination and the spatial orientation of children, and could be visually and sensually very rewarding.

Figure 61:
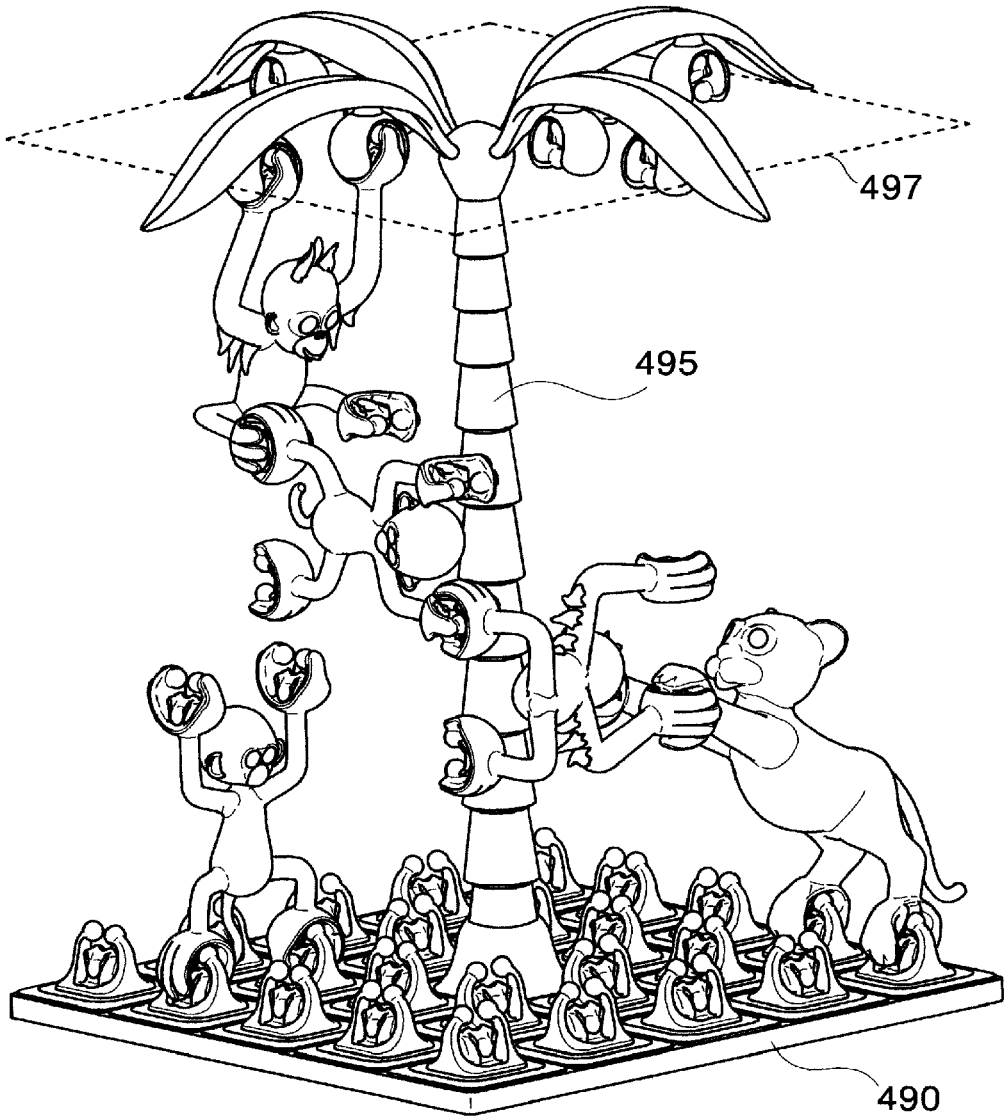
FIG. 61 is an isometric view of a three-dimensional board element with a plurality of construction elements attached thereto.
Figure 62:
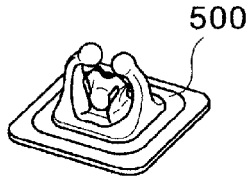
FIG. 62 is an isometric view of a single board unit.
Figure 63:
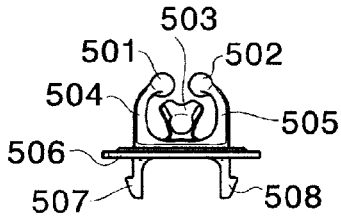
FIG. 63 is a side view of the single board unit.
Figure 64:
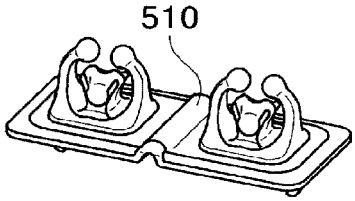
FIG. 64 is an isometric view of a double board unit.
Figure 65:
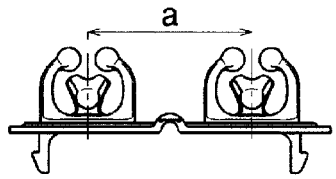
FIG. 65 is a side view of the double board unit.

FIG. 61 depicts a three-dimensional modular board element composed of a planar board element 490 and a tree-like structure 495 that can be removably inserted in the middle of the planar board by means known to the art. The planar board element is substantially identical to the previously described element 480, except that there are receiving means added in the middle for receiving the tree-like structure. The coupling members of the three-dimensional board are thus grouped in two sets and arranged in two separate planes. Twenty-four coupling members are arranged in the lower plane of the planar element 490, and eight coupling members are arranged in upper plane 497 that is substantially parallel to the said first plane.

Games of different character can be played by combining the three-dimensional playing board with a plurality of construction elements as playing pieces. In one variation, the objective of the players is to make a connection from their starting side on the lower plane to an opposite coupling member belonging to the upper plane, as shown in FIG. 61.

Figure 66:
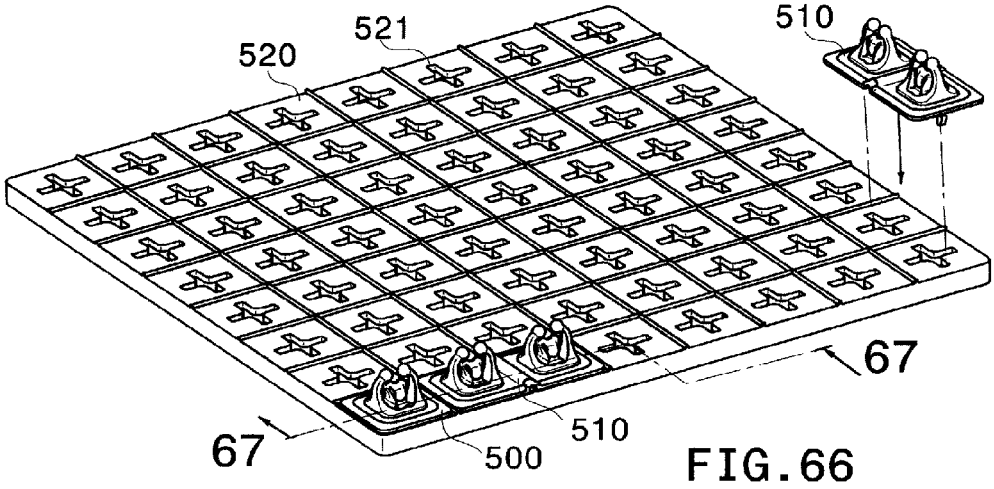
FIG. 66 is an isometric view of a board base with a plurality of attachable board units inserted therein.
Figure 67:
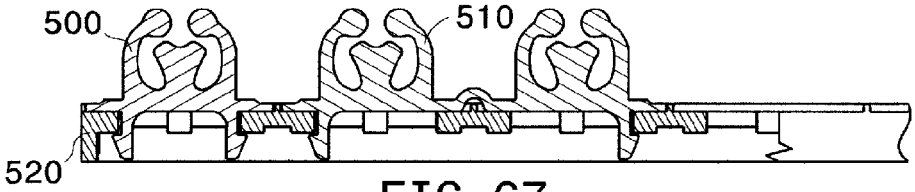
FIG. 67 is a partial sectional view taken along the lines 67-67 in FIG. 66.
Figure 68:
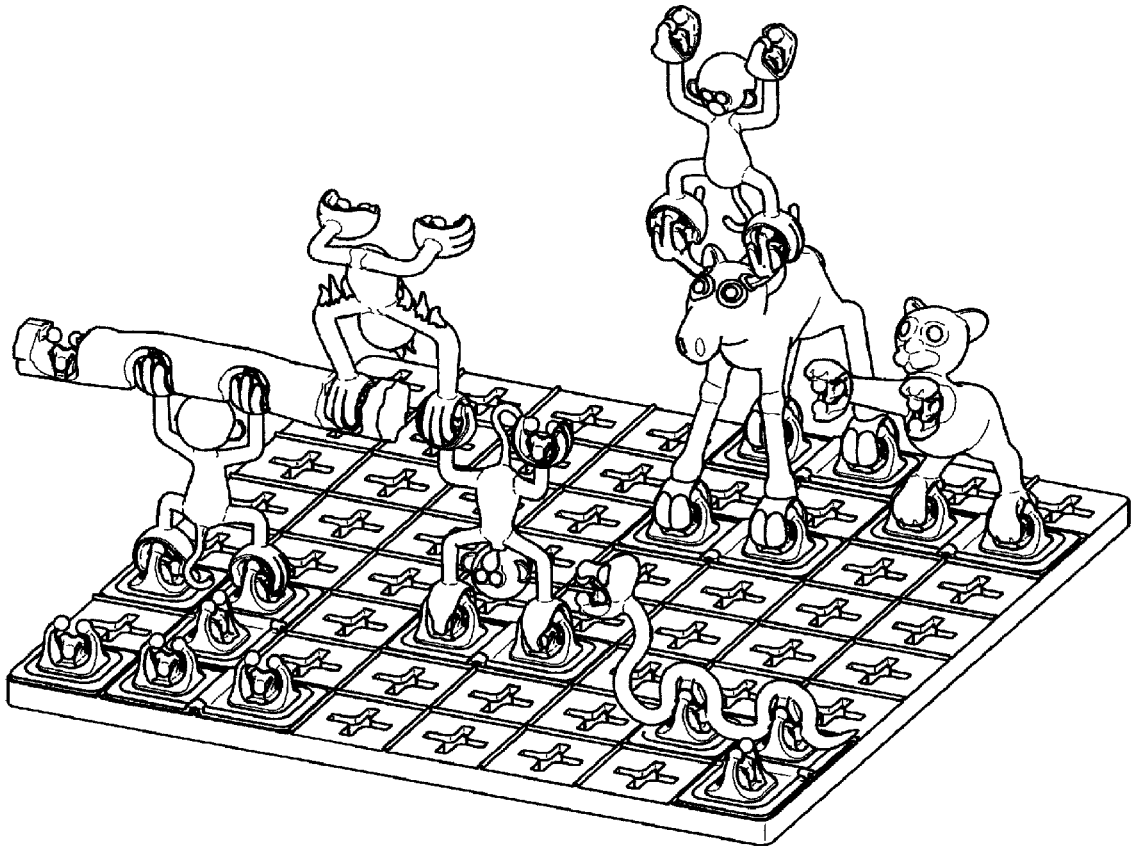
FIG. 68 is an isometric view of a board base with a plurality of board units and construction elements appended thereto.

FIGS. 62 to 65 depict board units being capable of insertion into a board base 520 shown in FIG. 66. The single board unit 500 comprises planar portion 506, two fingers (504 and 505), two spherical protrusions (501 and 502), receiving block 503, and two hooks (507 and 508) on the opposite side of the planar portion. The double board unit 510 is equivalently built, but comprises two integrally joined identical coupling members positioned at a unit distance "a" from each other. The board base 520 shown in FIG. 66 includes a plurality of cross-shaped holes 521, positioned in such a way that the board units 500 and 510 can be inserted into the board base along any of the two main directions by the means of the said hooks and holes, as shown in detail in the partial cross-sectional view in FIG. 67. This system increases the diversity and the complexity of the games because the player individually contemplates the best way of positioning the board units before appending other playing pieces in order to achieve the required result. At the end of the game the board units can be detached from the board base. An application of the system as a playing board for games is depicted in FIG. 68.

Figure 69:
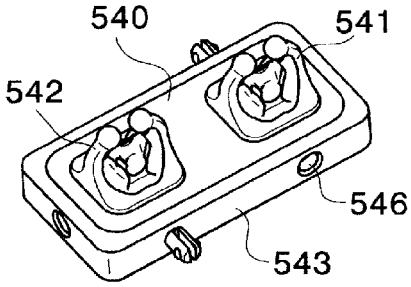
FIG. 69 is an isometric view of an interconnectable board element.
Figure 70:
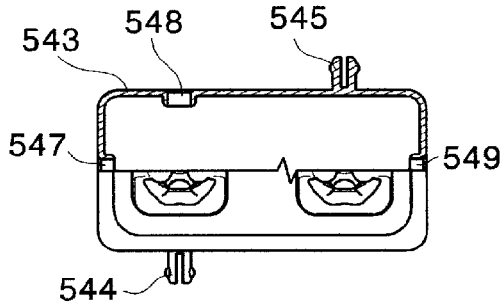
FIG. 70 is a partial sectional top view of the interconnectable board element shown in FIG. 69.
Figure 71:
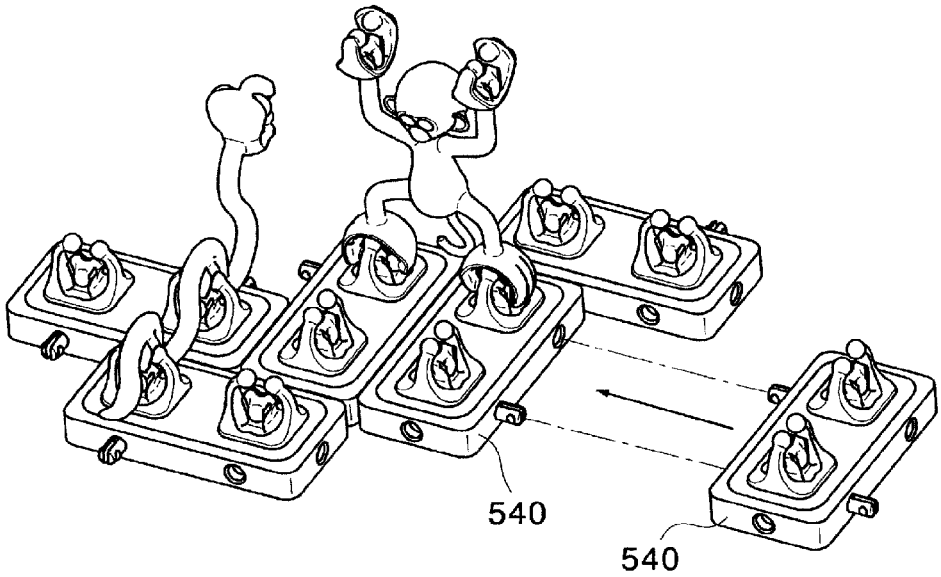
FIG. 71 is an isometric view of a game board formed by a plurality of interconnectable board elements.

FIGS. 69 and 70 show an interconnectable board element 540 comprising two coupling members (541 and 542) integrated to a planar body that has a normally extending peripheral flange 543. The peripheral flange further includes two split spins (544 and 545) and four holes (546 through 549). The board elements can be interconnected sideways in various combinations by inserting said pins into corresponding holes. Thus, differently shaped playing boards can be first defined by the players for use in various board games where additional construction elements are consecutively appended. In another application as a domino-style game illustrated in FIG. 71, the first player places a first board element on the table. Other players continue by attaching consecutive board elements and/or other playing pieces. The player who has first assembled all her/his board elements to the expanding playing board is the winner of the game.

Figure 72:
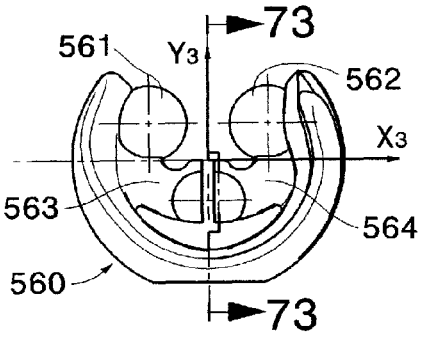
FIG. 72 is a side front view of an alternative coupling member.
Figure 73:
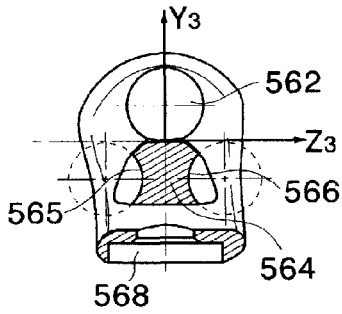
FIG. 73 is a sectional view taken along the line 73-73 in FIG. 72.
Figure 74:
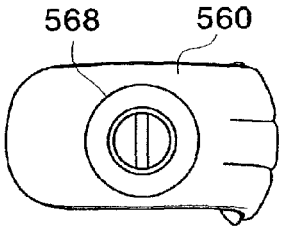
FIG. 74 is a bottom view of the coupling member shown in FIG. 72.

FIGS. 72 through 74 depict an alternative coupling member embodiment 560. This coupling member operates on the same basic principles as the previously disclosed embodiment. The substantial difference is that the receiving block is split into two halves 563 and 564, the Y3Z3 plane substantially being the splitting element. The halves are integrally attached to the protrusions 561 and 562 and to the exterior portion of the coupling member. Each receiving half-block includes two recessed portions, as it is illustrated in the sectional view of FIG. 73 where the cut receiving half-block 564 includes recessed portions 565 and 566. Since in this embodiment the bottom part of the coupling member is free of any interior structure, it can accommodate an attachment hole 568 in that area. Therefore, the coupling member is suitable to be manufactured separately as a standard unit, and then assembled to the main body of the construction elements. Another difference is that the receiving block halves also deflect from each other during the coupling process, their deflection magnitude being substantially smaller than the one of the protrusions. This small deflection, however, facilitates the coupling and attributes to a more expressive "snap-fit" effect. On the other hand, the connection is not as stable as the one achieved by the preferred embodiment because the retention forces act closer to the center of the connection.

Figure 75:
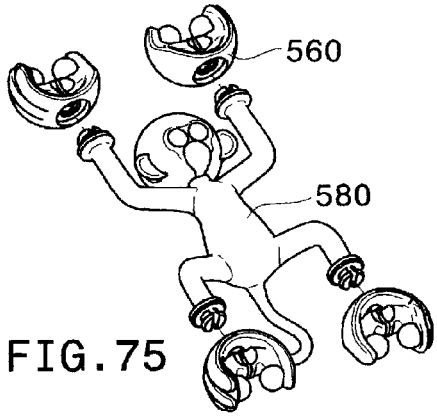
FIG. 75 is an isometric view of a monkey-like construction element where the four couplings members are attachable to the body member.
Figure 76:
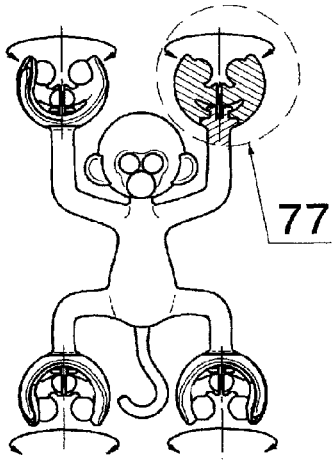
FIG. 76 is a front partial sectional view a monkey-like element having four coupling members rotatably attached thereto.
Figure 77:
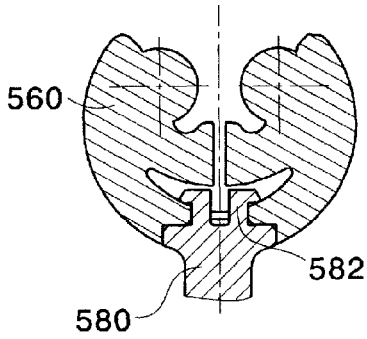
FIG. 77 is a detailed view of the area marked "77" in FIG. 76.

In FIG. 75, four coupling member units 560 are assembled to the body member 580 to form a construction element. As shown in FIG. 76, the coupling member units are rotatable about their respective coupling directions, so that the diversity of ways in which the construction element can be joined to other elements is increased by the acquired possibility of adapting the angular orientation. If the attachment hole 568 in FIG. 74 and the mating portion of the body member 580 are made with non-circular instead of circular shape, the coupling member becomes fixed to the body member after the assembly. The detailed view in FIG. 77 shows the split-pin means 582 for assembling the coupling member unit 560 to the body member 580.

Figure 78:
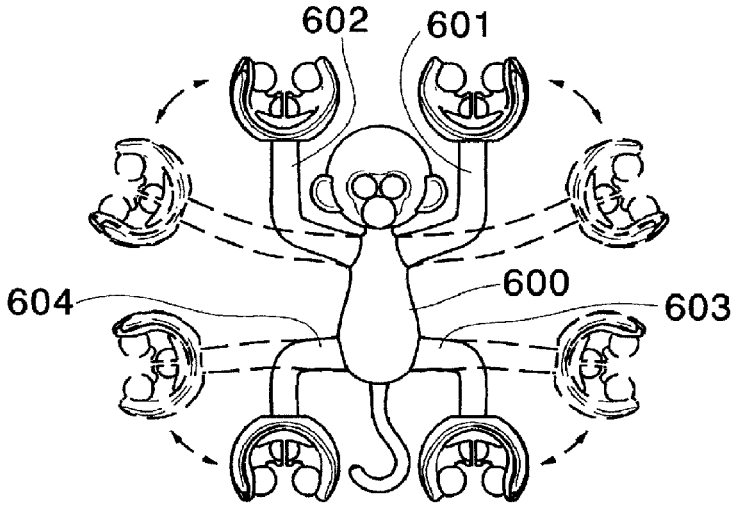
FIG. 78 is a front view of a monkey-like element with flexible limbs.

The following two figures show construction elements with movable coupling members. FIG. 78 depicts construction element 600 wherein the four limbs (601 to 604) are made of material that is different from the material of the rest of the element. These limbs are then joined to the body member on one and to the coupling members on the other side by means known to the art. The material of the limbs is preferably rubber, or another very bendable material such as a fabric string. As such, the construction element can acquire extreme shapes by bending and twisting the deformable limbs. A plurality of such elastic elements can be joined in a diversity of intermingled, twisted, and comic shapes.

Figure 79:
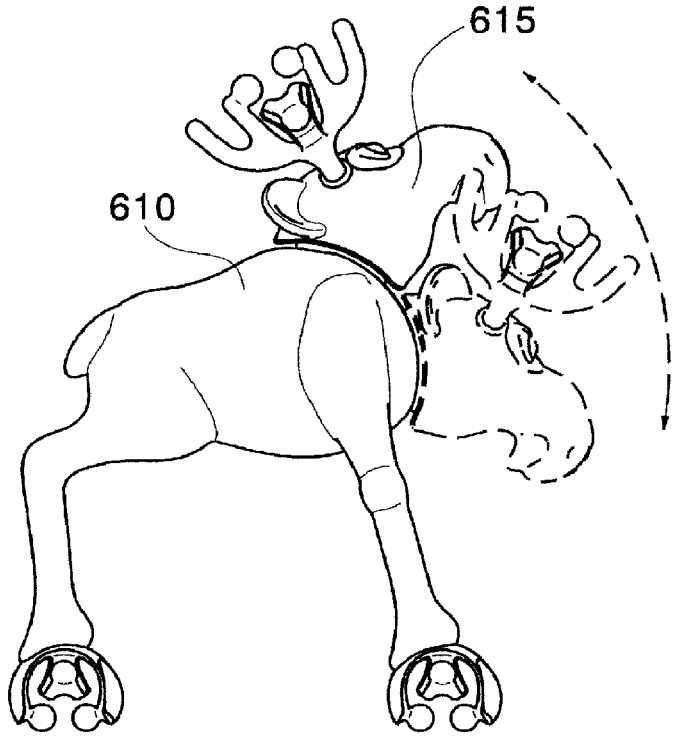
FIG. 79 is a side view of a moose-like element having a movable head portion.

In FIG. 79, a construction element 610 comprises head portion 615 rotatably connected to the main body of the element. Any structure of construction elements appended to the antler-like coupling members of element 610 will change its position, respectively, if the head portion is moved.

Figure 80:
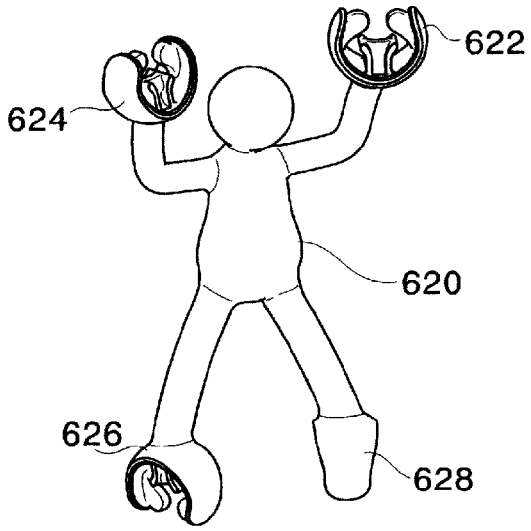
FIG. 80 is an isometric view of a humanoid-like construction element having alternative coupling member embodiments.
Figure 81:
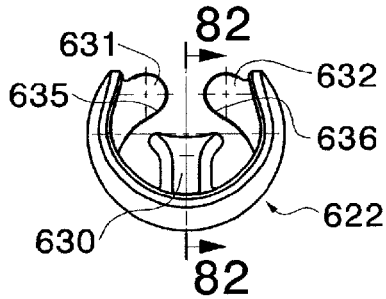
FIG. 81 is a detailed side view of the alternative coupling member embodiment shown in FIG. 80.
Figure 82:
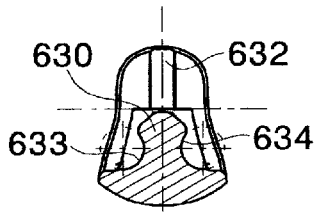
FIG. 82 is a sectional view taken along the line 82-82 in FIG. 81.
Figure 83:
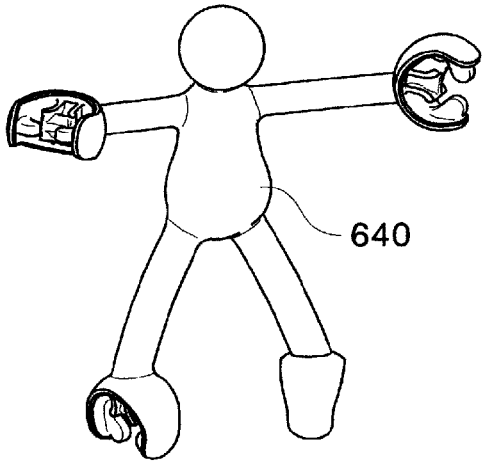
FIG. 83 is an isometric view of alternative humanoid-like element.
Figure 84:
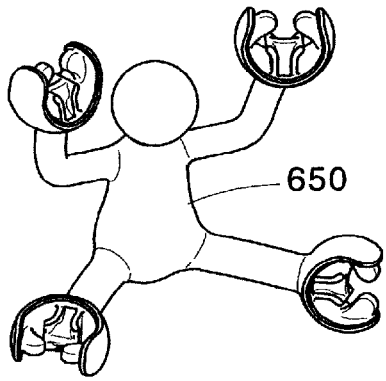
FIG. 84 is an isometric view of yet a further alternative humanoid-like element.
Figure 85:
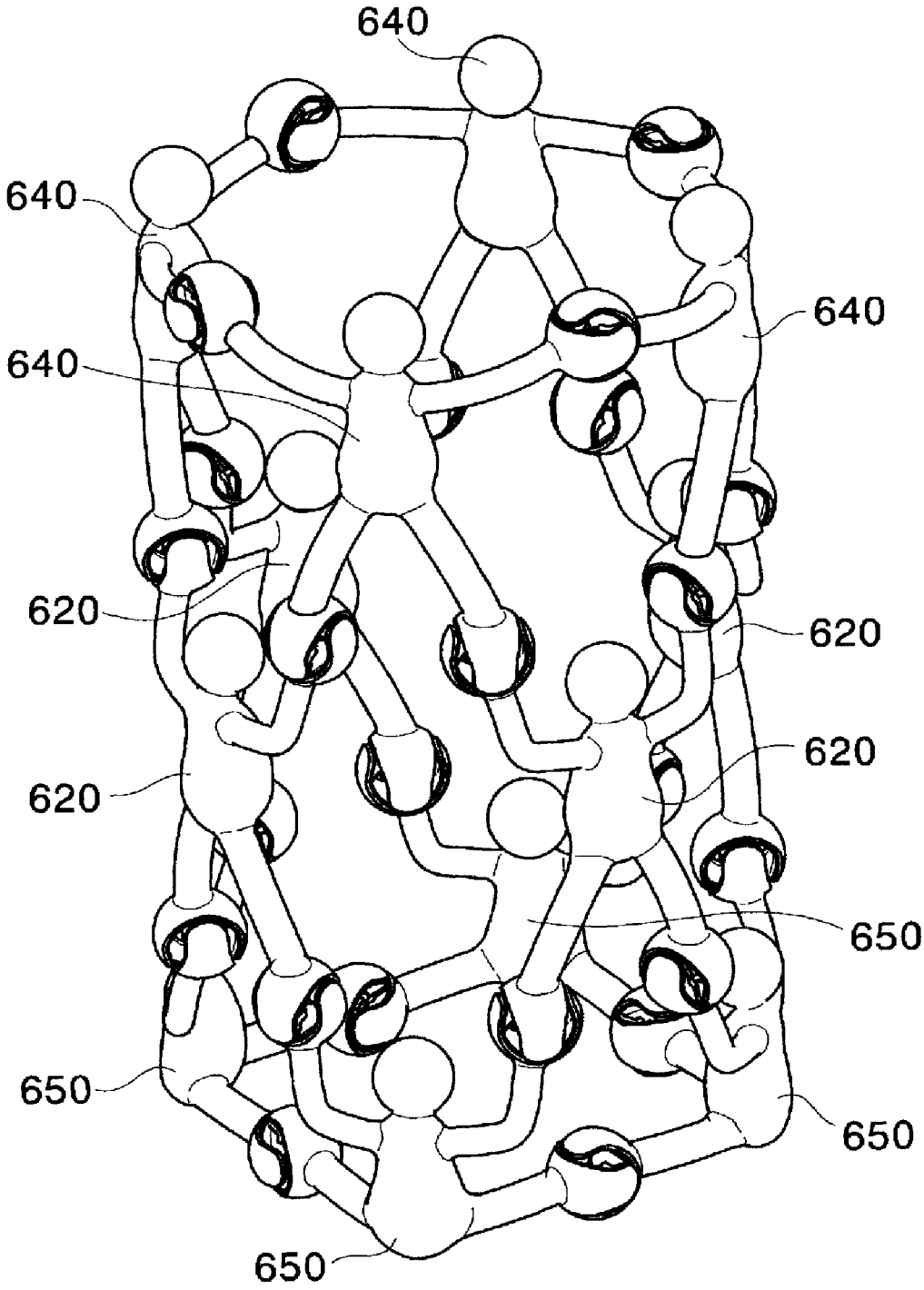
FIG. 85 is an isometric view of a cylindrical structure assembled from a plurality of humanoid-like construction elements.
Figure 86:
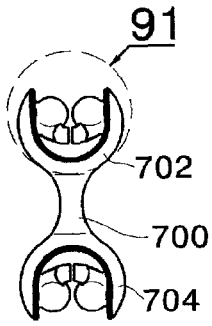
FIG. 86 shows a construction element having two coupling members.
Figure 87:
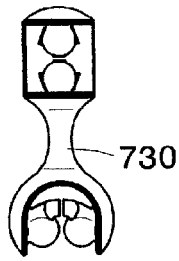
FIG. 87 shows another element with two coupling members.
Figure 88:
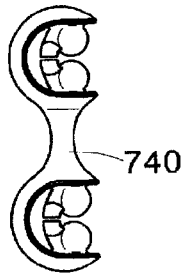
FIG. 88 shows a further alternative element with two coupling members.
Figure 89:
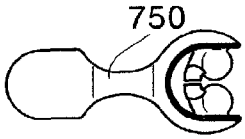
FIG. 89 shows yet a further alternative element with two coupling members.
Figure 90:
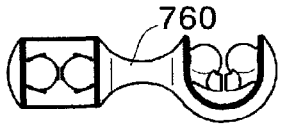
FIG. 90 shows an additional alternative element with two coupling members.

FIG. 80 shows a humanoid-like construction element 620 comprising four coupling members (622, 624, 626, and 628) that have an alternative shape. A front and a sectional view of the alternative coupling member are shown in FIGS. 81 and 82, respectively. Instead of having spherical shape as in the preferred embodiment, the protrusions 631 and 632 are simple extrusions of curved profiles (635 and 636) with a circular tip. The receiving block 630 includes recesses 633 and 634 that correspond to the shape of the protrusions. FIGS. 83 and 84 depict two other humanoid-like construction elements 640 and 650. An application of the three construction elements 620, 640 and 650 in a construction set is shown in FIG. 85. The assembled structure is of cylindrical shape and is suitable for use as a cup holder.

Figure 91:
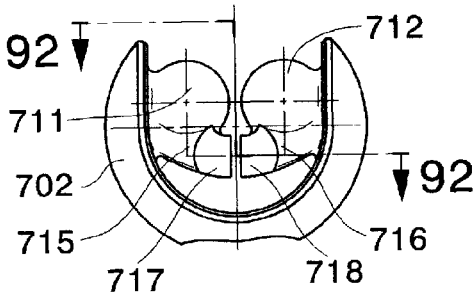
FIG. 91 is a detailed view the area marked "91" in FIG. 86 showing a coupling member with alternative interior locking means.
Figure 92:
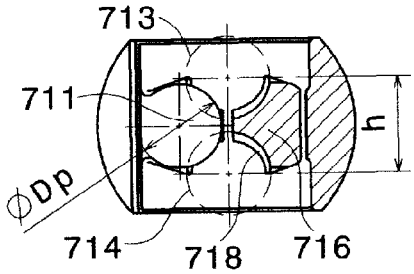
FIG. 92 is a sectional view taken along the lines 92-92 in FIG. 91.

FIGS. 86 through 90 show five construction elements with similar appearance (700, 730, 740, 750 and 760), each of which comprises two coupling members having a spherical outer surface. The coupling members are differently oriented for the five elements. The coupling members also have alternatively built interior locking portions compared to the previous ones. A detailed view of the alternative coupling member 702 is given in FIG. 91. It is characteristic that the spherical protrusions 711 and 712 are relatively bigger and positioned closely to each other as compared to the previously disclosed embodiments. They are also positioned closer to the centre of the coupling member. The receiving block is split and comprises two halves 715 and 716 with four recessed portions (717, 718) and another two on the opposite side of the coupling member). The four recessed portions are defined by two spheres represented by two circles 713 and 714 in the sectional view in FIG. 92. Based on the same basic principles of the construction system, circles 713 and 714 also represent the positions of two spherical protrusions of an engaging, 90-degree oriented coupling member. It is then apparent that the four spherical protrusions of two mutually engaging coupling members come into contact and must deflect away from each other in order to pass between each other.

Mathematically, this occurs when the diameter of the protrusions is bigger than 0.707 times the distance between the centers of the defining spheres ($Dp>0.707*h$). After they have reached maximum deflection (their centers defining a common plane), the spherical protrusions retract back and snap into the corresponding recesses. Thus, aligning means are provided solely by the spherical protrusions so that this variation of the system is characterized by robust and quick engagement that requires almost no alignment efforts by the player. However, the stability is reduced relative to the previous coupling member embodiments. This system is suitable for applications where the construction elements form closed geometric shapes and additional stability is provided by the compactness of the structure.

Figure 93:
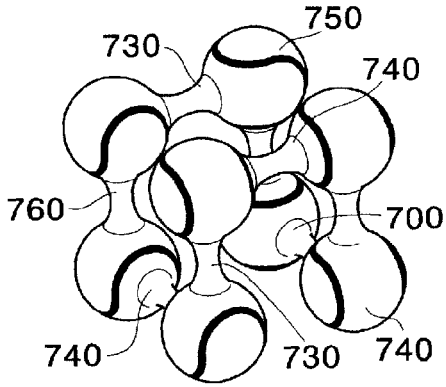
FIG. 93 is an isometric view of a construction puzzle wherein the elements shown in FIGS. 86 through 90 form a cube-like structure.

FIG. 93 shows a construction puzzle set composed of construction elements 700, 730, 740 and 750, which can create a cube-like structure when connected to each other in a proper manner. The spherical outer surfaces of any two connected coupling members form a sphere.

Figure 94:
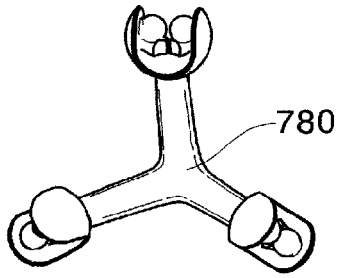
FIG. 94 is an isometric view of a construction element having three coupling members positioned along three orthogonal directions.
Figure 95:
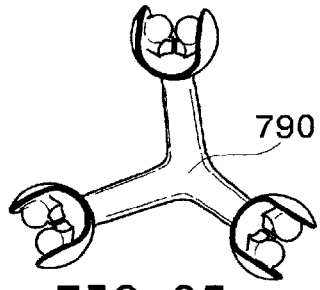
FIG. 95 is an isometric view of another construction element having three coupling members positioned along three orthogonal directions.
Figure 96:
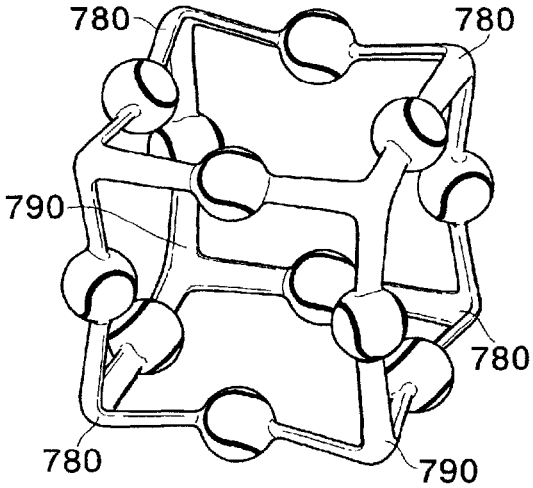
FIG. 96 is an isometric view of a construction puzzle wherein the elements shown in FIGS. 94 and 95 form a cube-like structure.
Figure 97:
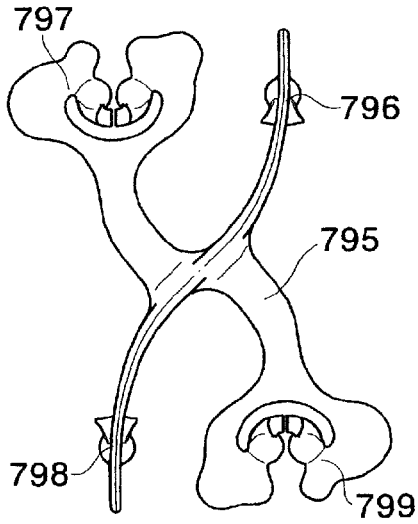
FIG. 97 is a front view of an abstractly shaped construction element having four coupling members.

FIGS. 94 and 95 show construction elements 780 and 790, respectively, each of which comprising three coupling members with coupling directions along three mutually orthogonal directions. They can be interconnected to form a cube-like structure illustrated in FIG. 96. A construction element 795 having an abstract shape is shown in FIG. 97 and comprises four coupling members (796 through 799). It illustrates that the coupling members according to this invention can take many other shapes and still preserve their functionality.

Figure 98:
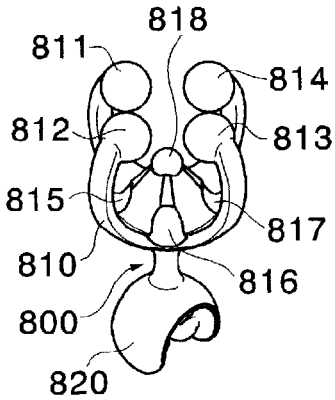
FIG. 98 is an isometric view of a construction element having differently sized and shaped coupling members; and, FIG. 99 shows an assembled position of two construction elements depicted in FIG. 98.
Figure 99:
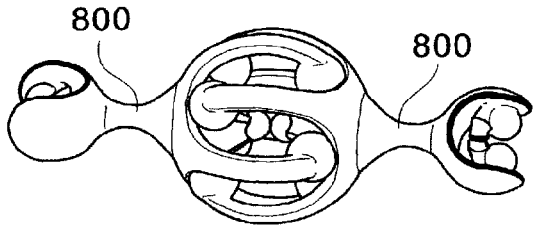

The construction elements according to this invention do not have to necessarily comprise identical interlocking portions. They can include coupling members of different sizes or types of interlocking portions, each coupling member being connectable only to a similarly built one, thereby increasing the challenges the player is facing. As an illustration, FIG. 98 shows a construction element 800 comprising two coupling members (810 and 820) with two interior locking portions of different size and shape. Furthermore, coupling member 810 illustrates that a coupling member according to this invention can also be made with a different number of interlocking spherical protrusions and recesses. In this example, four axially symmetric spherical protrusions (811 through 814) correspond to four recesses (815, 816, 817 and one opposite of 816 not visible in the view.) The recesses are positioned in planes rotated for 45 degrees about the coupling direction relative to the planes of the protrusions. The central ball 818 serves as a limiting feature in such a way that it comes into contact with the corresponding ball of an engaging coupling member when the engagement is complete, and limits unwanted deformations in case the application of force persists further. The assembled position of two construction elements 800 is depicted in FIG. 99.

It is apparent to those skilled in the art that the elements of the construction system according to this invention can take other shapes from the ones disclosed, without departing from the scope of the invention. For example: the construction system can be used as a chess-set having a planar board element and attachable chess figure elements; the construction elements can be shaped as modular blocks that build structures such as houses, aircrafts, cars or similar when put together in a predetermined manner; the protrusions and their corresponding recesses can be defined by a single or double-curved surface that does not resemble any regular geometric shape; the protrusions can be omitted in some of the construction elements so that they provide one degree of freedom to the appended elements (rotation about the common axis of the two spherical recesses); the guiding walls can be omitted or can be made higher if additional stability of the connection is required; etc.

While the invention has been described in detail and with reference to specific embodiments related generally to toy construction sets, it will be also understood that the elements of the invention can equally be used in other engineering, architectural or general applications. In one general application, coupling units similar to the board units 500 and 510 (FIGS. 62 through 65) can be manufactured as standard parts attachable by other means to structures such as walls, ceilings or similar. These coupling units can be then used for removably attaching objects such as picture frames, clocks, or similar. The attached objects also include corresponding coupling apertures. By providing various stylistic shapes to the coupling units, these can fit aesthetically into the environment even if no objects are attached to them.

In another application, a planar board comprising a pattern of coupling units can be attached to a vertical wall to serve as a key shelf. A key ring with a set of keys also includes a distinctively shaped or colored coupling unit that can be removably attached to one of the coupling units on the key shelf. A key ring can also include a figure with more than one coupling unit, similar to the previously disclosed construction elements. Thereby, the seemingly trivial action of disposing a key can be enriched with entertainment dimensions.

Yet in another application, one coupling member is a substantial part of a handle. Different tool applicators, such as a brush tip for instance, also include coupling members. The tool applicators can than be quickly and securely attached to the handle and exchanged when needed.

While only several embodiments of the present invention have been shown and described, it will be obvious to those skilled in the art that many modifications may be made to the present invention without departing from the spirit and scope thereof.

What is claimed is:

1. A construction system, comprising:

a plurality of construction elements with each construction element of said construction elements including a body member and a plurality of coupling members, wherein said plurality of coupling members includes a first coupling member belonging to a first construction element of said plurality of construction elements and being interlockable with a second coupling member of said plurality of coupling members belonging to a second construction element of said plurality of construction elements, wherein:

each coupling member of said plurality of coupling members having a center-point and an orthogonal coordinate system XYZ associated thereto, said center-point being an origin of said coordinate system XYZ;

each said coupling member of said coupling members having a coupling direction associated thereto, said coupling direction being substantially the Y-axis of said coordinate system XYZ;

each said coupling member of said plurality of said coupling members comprising interior locking means disposed around said centerpoint and an exterior portion disposed peripherally relative to said interior locking means with said interior locking means having two protrusions and a receiving block, said two protrusions being substantially defined in the XY-plane of said coordinate system XYZ and being disposed on the negative side of the Y-axis of said coordinate system XYZ, said two protrusions being substantially symmetric to one another relative to the YZ-plane of said coordinate system XYZ, said receiving block further comprising two recesses being substantially defined in the YZ-plane of said coordinate system XYZ and being disposed on the positive side of the Y-axis of said coordinate system XYZ, said two recesses being substantially symmetric to one another relative to the XY-plane of said coordinate system XYZ with each recess of said two recesses having at least one concave surface portion complementary to a corresponding convex surface portion belonging to each protrusion of said two protrusions; and, said receiving block further comprising a tapered portion extending from said center-point and said recesses, said tapered portion including at least one control geometric parameter, so that, upon presenting said first coupling member to said second coupling member along said coupling direction and in mutually orthogonal orientations:

said protrusions of said first coupling member unobstructively transverse by, without requiring contact, said protrusions of said second coupling member towards said tapered portion for centering and aligning said first coupling member relative to said second coupling member;

said tapered portion of said second coupling member urges said protrusions of said first coupling member to resiliently deflect away from each other and subsequently retract and settle into said recesses of said second coupling member;

said tapered portion of said first coupling member urges said protrusions of said second coupling member to resiliently deflect away from each other and subsequently retract and settle into said recesses of said first coupling member; and, said exterior portion provides resilient means for said deflection and retraction of said protrusions;

whereby, said control geometric parameter defines and controls an amount of applied force needed to couple, or de-couple, said construction elements in said construction system, said tapered portion of said first coupling member and said tapered portion of said second coupling member, in a coupled position, substantially contact one another at said center-point for preventing over-engagement or unwanted deformation of said exterior portion if excessive coupling force is applied, and said protrusions and recesses, in coupled position, provide for full contact between said first coupling member and said second coupling member on at least four predetermined and controllable surface portions in two mutually orthogonal planes, thereby enabling a secure, stable and controllable connection.

2. The construction system according to claim 1, wherein:

said two protrusions are substantially defined by a first set of two nonintersecting spheres whose centers lie in the XY-plane of said coordinate system XYZ, said centers of said two intersecting spheres having a common negative Y-axis coordinate;

said two recesses are substantially defined by a second set of two nonintersecting spheres whose centers lie in the YZ-plane of said coordinate system XYZ, said centers of said spheres having a common positive Y-axis coordinate;

said negative Y-axis coordinate of said centers of said first set of said spheres and said positive Y-axis coordinate of said centers of said second set of spheres are of same absolute value; and, said exterior portion integrally connects to said protrusions and said receiving block for forming an open loop around said center-point, so that said loop is open in an area between said protrusions.

3. The construction system according to claim 1, wherein said receiving block comprises two block halves, said two block halves being divided one from another substantially at the YZ-plane of said coordinate system, wherein each of said block halves integrally connects to corresponding one of said protrusions, whereby said block halves deflect away from each other together with said protrusions.

4. The construction system according to claim 1, the diameter of said spheres defining said protrusions is bigger than 0.707 times the distance between the centers of said spheres defining said recesses, whereby said protrusions of said first coupling member urge said protrusions of said second coupling member to resiliently deflect away from each other, whereby said protrusions of said second coupling member urge said protrusions of said first coupling member to resiliently deflect away from each other.

5. The construction system according to claim 1, wherein at least one of said construction elements resembles an animal, wherein said exterior portions of said coupling members of said animal-like construction element resemble animal body parts selected from the group consisting of a hand, a foot, a paw, a jaw, a trunk lip, an antler branch, a hoof, a tentacle and a curved torso segment.

6. The construction system according to claim 1, wherein said exterior portion has a shape selected from the group consisting of a C-shape and a U-shape.

7. The construction system according to claim 1, wherein said exterior portion of said coupling members comprises a substantially spherical exterior surface, wherein said exterior portions of said first and second coupling members substantially form a sphere in interlocked position.

8. The construction system according to claim 1, wherein each of said construction elements comprises at least one group of at least two coupling members, so that said group is coupleable with another group of coupling members belonging to any other one of said construction elements.

9. The construction system according to claim 1, each one of said construction elements has at least two defining orthogonal directions associated thereto, whereby said center-points of said coupling members of said construction element are disposed relative to said orthogonal directions in such a way that the distance between any two of said center-points measured along any one of said orthogonal directions is an integer multiple of a predefined distance unit value ("a").

10. The construction system according to claim 1, wherein all of said construction elements interconnect one to another to form a structure resembling a predetermined shape, wherein all of said couplings members couple one to another and none remains uncoupled, whereby at least one unique combination of connecting said construction elements one to another leads to said predetermined shape.

11. The construction system according to claim 10, said construction elements form a structure resembling a geometric shape selected from the group consisting of a cylinder, a parallelepiped, a sphere and a cube.

12. The construction system according to claim 11, said center-points of said coupling members substantially coincide with geometric entities that define said geo-metric shape, said geometric entities being selected from the group consisting of a vertex, an edge and a face.

13. The construction system according to claim 1, further comprising a board element having a substantially planar portion suitable for placing on a horizontal playing surface and at least three coupling members arranged in a predetermined order, wherein said coupling members are coupleable with said coupling members belonging to said construction elements, so that said construction elements and said board element are interconnectable in a variety of different combinations, whereby at least one unique combination leads to a predetermined result.

14. The construction system according to claim 1, further comprising at least three board unit elements and a board base, each of said board unit elements comprising a substantially planar portion and at least one integrally attached coupling member, said coupling member being coupleable with said coupling members of said construction elements, wherein each of said board unit elements further comprises attaching means for removably attaching said board unit element to said board base, so that said board base said board unit elements and said construction elements are inter-connectable in a variety of different combinations.

15. The construction system according to claim 1, further comprising at least three interconnectable board elements having planar portions suitable for placing on a horizontal playing surface, each of said interconnectable board elements comprising a peripheral flange and at least one integrally attached coupling member, said coupling member being coupleable with said coupling members of said construction elements, each of said interconnectable board elements further comprising attaching means disposed along a length of said peripheral flange, whereby said interconnectable board elements is connectable one to another by means of said attaching means in a variety of different combinations, whereby said construction elements are capable of being further appended to said interconnectable board elements.

16. The construction system according to claim 1, wherein at least one of said construction elements includes at least two removably attached coupling members.

17. The construction system according to claim 1, wherein said body member of at least one of said construction elements comprises at least one portion made of bendable material.

18. The construction system according to claim 1, wherein said body member of at least one of said construction elements comprises at least two portions, wherein each of said portions includes at least one coupling member, whereby said portions are rotatably connected one to another.

* * * * *